US010950425B2

(12) United States Patent
Verenchikov et al.

(10) Patent No.: US 10,950,425 B2
(45) Date of Patent: Mar. 16, 2021

(54) MASS ANALYSER HAVING EXTENDED FLIGHT PATH

(71) Applicants: Micromass UK Limited, Wilmslow (GB); LECO CORPORATION, St. Joseph, MI (US)

(72) Inventors: Anatoly Verenchikov, Wilmslow (GB); Mikhail Yavor, St. Petersburg (RU)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/325,965

(22) PCT Filed: Aug. 11, 2017

(86) PCT No.: PCT/EP2017/070508
§ 371 (c)(1),
(2) Date: Feb. 15, 2019

(87) PCT Pub. No.: WO2018/033494
PCT Pub. Date: Feb. 22, 2018

(65) Prior Publication Data

US 2019/0206669 A1 Jul. 4, 2019

(30) Foreign Application Priority Data

Aug. 16, 2016 (GB) ..... 1613988

(51) Int. Cl.
*H01J 49/40* (2006.01)
*H01J 49/06* (2006.01)
(Continued)

(52) U.S. Cl.
CPC ..... *H01J 49/408* (2013.01); *H01J 49/0031* (2013.01); *H01J 49/061* (2013.01); *H01J 49/4245* (2013.01)

(58) Field of Classification Search
CPC .... H01J 49/0027; H01J 49/0031; H01J 49/06; H01J 49/061; H01J 49/408; H01J 49/42; H01J 49/4245
See application file for complete search history.

(56) References Cited

U.S. PATENT DOCUMENTS 3,898,452 A 8/1975 Hertel
4,390,784 A 6/1983 Browning et al.
(Continued)

FOREIGN PATENT DOCUMENTS

CA 2412657 C 5/2003
CN 101369510 A 2/2009
(Continued)

OTHER PUBLICATIONS

Sakurai (Sakurai et al, "A New Multi-Passage Time-of-Flight Mass Spectrometer at JAIST" Nuclear Instruments & Methods in Physics Research A 427 (1999) 182-186) (Year: 1999).*
(Continued)

*Primary Examiner* — David E Smith
(74) *Attorney, Agent, or Firm* — Kacvinsky Daisak Bluni PLLC

(57) ABSTRACT

A time-of-flight or electrostatic trap mass analyzer is disclosed comprising: an ion flight region comprising a plurality of ion-optical elements (30-35) for guiding ions through the flight region in a deflection (x-y) plane. The ion-optical elements are arranged so as to define a plurality of identical ion-optical cells, wherein the ion-optical elements in each ion-optical cell are arranged and configured so as to generate electric fields for either focusing ions travelling in parallel at an ion entrance location of the cell to a point at an ion exit location of the cell, or for focusing ions diverging from a point at the ion entrance location to travel parallel at the ion exit location. Each ion-optical cell comprises a plurality of electrostatic sectors having different deflection radii for
(Continued)

bending the flight path of the ions in the deflection (x-y) plane. The ion-optical elements in each cell are configured to generate electric fields that either (i) have mirror symmetry in the deflection plane about a line in the deflection plane that is perpendicular to a mean ion path through the cell at a point half way along the mean ion path through the cell, or (ii) have point symmetry in the deflection plane about a point in the deflection plane that is half way along the mean ion path through the cell. The ion-optical elements are arranged and configured such that, in the frame of reference of the ions, the ions are guided through the deflection plane in the ion-optical cells along mean flight paths that are of the same shape and length in each ion-optical cell.

20 Claims, 7 Drawing Sheets

(51) Int. Cl.
*H01J 49/42* (2006.01)
*H01J 49/00* (2006.01)

(56) References Cited

U.S. PATENT DOCUMENTS 4,691,160 A 9/1987 Ino
4,731,532 A 3/1988 Frey et al.
4,855,595 A 8/1989 Blanchard
5,017,780 A 5/1991 Kutscher et al.
5,107,109 A 4/1992 Stafford, Jr. et al.
5,128,543 A 7/1992 Reed et al.
5,202,563 A 4/1993 Cotter et al.
5,331,158 A 7/1994 Dowell
5,367,162 A 11/1994 Holland et al.
5,396,065 A 3/1995 Myerholtz et al.
5,435,309 A 7/1995 Thomas et al.
5,464,985 A 11/1995 Cornish et al.
5,619,034 A 4/1997 Reed et al.
5,654,544 A 8/1997 Dresch
5,689,111 A 11/1997 Dresch et al.
5,696,375 A 12/1997 Park et al.
5,719,392 A 2/1998 Franzen
5,763,878 A 6/1998 Franzen
5,777,326 A 7/1998 Rockwood et al.
5,834,771 A 11/1998 Yoon et al.
5,955,730 A 9/1999 Kerley et al.
5,994,695 A 11/1999 Young
6,002,122 A 12/1999 Wolf
6,013,913 A 1/2000 Hanson
6,020,586 A 2/2000 Dresch et al.
6,080,985 A 6/2000 Welkie et al.
6,107,625 A 8/2000 Park
6,160,256 A 12/2000 Ishihara
6,198,096 B1 3/2001 Le Cocq
6,229,142 B1 5/2001 Bateman et al.
6,271,917 B1 8/2001 Hagler
6,300,626 B1 10/2001 Brock et al.
6,316,768 B1 11/2001 Rockwood et al.
6,337,482 B1 1/2002 Francke
6,384,410 B1 5/2002 Kawato
6,393,367 B1 5/2002 Tang et al.
6,437,325 B1 8/2002 Reilly et al.
6,455,845 B1 9/2002 Li et al.
6,469,295 B1 10/2002 Park
6,489,610 B1 12/2002 Barofsky et al.
6,504,148 B1 1/2003 Hager
6,504,150 B1 1/2003 Verentchikov et al.
6,534,764 B1 3/2003 Verentchikov et al.
6,545,268 B1 4/2003 Verentchikov et al.
6,570,152 B1 5/2003 Hoyes
6,576,895 B1 6/2003 Park
6,580,070 B2 6/2003 Cornish et al.
6,591,121 B1 7/2003 Madarasz et al.
6,614,020 B2 9/2003 Cornish
6,627,877 B1 9/2003 Davis et al.
6,646,252 B1 11/2003 Gonin
6,647,347 B1 11/2003 Roushall et al.
6,664,545 B2 12/2003 Kimmel et al.
6,683,299 B2 1/2004 Fuhrer et al.
6,694,284 B1 2/2004 Nikoonahad et al.
6,717,132 B2 4/2004 Franzen
6,734,968 B1 5/2004 Wang et al.
6,737,642 B2 5/2004 Syage et al.
6,744,040 B2 6/2004 Park
6,744,042 B2 6/2004 Zajfman et al.
6,747,271 B2 6/2004 Gonin et al.
6,770,870 B2 8/2004 Vestal
6,782,342 B2 8/2004 LeGore et al.
6,787,760 B2 9/2004 Belov et al.
6,794,643 B2 9/2004 Russ, IV et al.
6,804,003 B1 10/2004 Wang et al.
6,815,673 B2 11/2004 Plomley et al.
6,833,544 B1 12/2004 Campbell et al.
6,836,742 B2 12/2004 Brekenfeld
6,841,936 B2 1/2005 Keller et al.
6,861,645 B2 3/2005 Franzen
6,864,479 B1 3/2005 Davis et al.
6,870,156 B2 3/2005 Rather
6,870,157 B1 3/2005 Zare
6,872,938 B2 3/2005 Makarov et al.
6,888,130 B1 5/2005 Gonin
6,900,431 B2 5/2005 Belov et al.
6,906,320 B2 6/2005 Sachs et al.
6,940,066 B2 9/2005 Makarov et al.
6,949,736 B2 9/2005 Ishihara
7,034,292 B1 4/2006 Whitehouse et al.
7,071,464 B2 7/2006 Reinhold
7,084,393 B2 8/2006 Fuhrer et al.
7,091,479 B2 8/2006 Hayek
7,126,114 B2 10/2006 Chernushevich
7,196,324 B2 3/2007 Verentchikov
7,217,919 B2 5/2007 Boyle et al.
7,221,251 B2 5/2007 Menegoli et al.
7,326,925 B2 2/2008 Verentchikov et al.
7,351,958 B2 4/2008 Vestal
7,365,313 B2 4/2008 Fuhrer et al.
7,385,187 B2 6/2008 Verentchikov et al.
7,388,197 B2 6/2008 McLean et al.
7,399,957 B2 7/2008 Parker et al.
7,423,259 B2 9/2008 Hidalgo et al.
7,498,569 B2 3/2009 Ding
7,501,621 B2 3/2009 Willis et al.
7,504,620 B2 3/2009 Sato et al.
7,521,671 B2 4/2009 Kirihara et al.
7,541,576 B2 6/2009 Belov et al.
7,582,864 B2 9/2009 Verentchikov
7,608,817 B2 10/2009 Flory
7,663,100 B2 2/2010 Vestal
7,675,031 B2 3/2010 Konicek et al.
7,709,789 B2 5/2010 Vestal et al.
7,728,289 B2 6/2010 Naya et al.
7,745,780 B2 6/2010 McLean et al.
7,755,036 B2 7/2010 Satoh
7,772,547 B2 8/2010 Verentchikov
7,800,054 B2 9/2010 Fuhrer et al.
7,825,373 B2 11/2010 Willis et al.
7,863,557 B2 1/2011 Brown
7,884,319 B2 2/2011 Willis et al.
7,932,491 B2 4/2011 Vestal
7,982,184 B2 7/2011 Sudakov
7,985,950 B2 7/2011 Makarov et al.
7,989,759 B2 8/2011 Holle
7,999,223 B2 8/2011 Makarov et al.
8,017,907 B2 9/2011 Willis et al.
8,063,360 B2 11/2011 Willis et al.
8,080,782 B2 12/2011 Hidalgo et al.
8,093,554 B2 1/2012 Makarov
8,237,111 B2 8/2012 Golikov et al.
8,354,634 B2 1/2013 Green et al.
8,395,115 B2 3/2013 Makarov et al.
8,492,710 B2 7/2013 Fuhrer et al.

(56) References Cited

U.S. PATENT DOCUMENTS 8,513,594 B2 8/2013 Makarov
8,633,436 B2 1/2014 Ugarov
8,637,815 B2 1/2014 Makarov et al.
8,642,948 B2 2/2014 Makarov et al.
8,642,951 B2 2/2014 Li
8,648,294 B2 2/2014 Prather et al.
8,653,446 B1 2/2014 Mordehai et al.
8,658,984 B2 2/2014 Makarov et al.
8,680,481 B2 3/2014 Giannakopulos et al.
8,723,108 B1 5/2014 Ugarov
8,735,818 B2 5/2014 Kovtoun et al.
8,772,708 B2 7/2014 Kinugawa et al.
8,785,845 B2 7/2014 Loboda
8,847,155 B2 9/2014 Vestal
8,853,623 B2 10/2014 Verenchikov
8,884,220 B2 11/2014 Hoyes et al.
8,921,772 B2 12/2014 Verenchikov
8,952,325 B2 2/2015 Giles et al.
8,957,369 B2 2/2015 Makarov
8,975,592 B2 3/2015 Kobayashi et al.
9,048,080 B2 6/2015 Verenchikov et al.
9,082,597 B2 7/2015 Willis et al.
9,082,604 B2 7/2015 Verenchikov
9,099,287 B2 8/2015 Giannakopulos
9,136,101 B2 9/2015 Grinfeld et al.
9,147,563 B2 9/2015 Makarov
9,196,469 B2 11/2015 Makarov
9,207,206 B2 12/2015 Makarov
9,214,322 B2 12/2015 Kholomeev et al.
9,214,328 B2 12/2015 Hoyes et al.
9,281,175 B2 3/2016 Haufler et al.
9,312,119 B2 4/2016 Verenchikov
9,324,544 B2 4/2016 Rather
9,373,490 B1 6/2016 Nishiguchi et al.
9,396,922 B2 7/2016 Verenchikov et al.
9,417,211 B2 8/2016 Verenchikov
9,425,034 B2 8/2016 Verentchikov et al.
9,472,390 B2 10/2016 Verenchikov et al.
9,514,922 B2 12/2016 Watanabe et al.
9,576,778 B2 2/2017 Wang
9,595,431 B2 3/2017 Verenchikov
9,673,033 B2 6/2017 Grinfeld et al.
9,679,758 B2 6/2017 Grinfeld et al.
9,683,963 B2 6/2017 Verenchikov
9,728,384 B2 8/2017 Verenchikov
9,779,923 B2 10/2017 Verenchikov
9,786,484 B2 10/2017 Willis et al.
9,786,485 B2 10/2017 Ding et al.
9,865,441 B2 1/2018 Damoc et al.
9,865,445 B2 1/2018 Verenchikov et al.
9,870,903 B2 1/2018 Richardson et al.
9,870,906 B1 1/2018 Quarmby et al.
9,881,780 B2 1/2018 Verenchikov et al.
9,899,201 B1 2/2018 Park
9,922,812 B2 3/2018 Makarov
9,941,107 B2 4/2018 Verenchikov
9,972,483 B2 5/2018 Makarov
10,006,892 B2 6/2018 Verenchikov
10,037,873 B2 7/2018 Wang et al.
10,141,175 B2 11/2018 Verentchikov et al.
10,141,176 B2 11/2018 Stewart et al.
10,163,616 B2 12/2018 Verenchikov et al.
10,186,411 B2 1/2019 Makarov
10,192,723 B2 1/2019 Verenchikov et al.
10,290,480 B2 5/2019 Crowell et al.
10,373,815 B2 8/2019 Crowell et al.
10,388,503 B2 8/2019 Brown et al.
10,593,525 B2 3/2020 Hock et al.
10,593,533 B2 3/2020 Hoyes et al.
10,622,203 B2 4/2020 Veryovkin et al.
10,629,425 B2 4/2020 Hoyes et al.
10,636,646 B2 4/2020 Hoyes et al.
2001/0011703 A1 8/2001 Franzen
2001/0030284 A1 10/2001 Dresch et al.
2002/0030159 A1 3/2002 Chernushevich et al.
2002/0107660 A1 8/2002 Nikoonahad et al.
2002/0190199 A1 12/2002 Li
2003/0010907 A1 1/2003 Hayek et al.
2003/0111597 A1 6/2003 Gonin et al.
2003/0232445 A1 12/2003 Fulghum
2004/0084613 A1 5/2004 Bateman et al.
2004/0108453 A1 6/2004 Kobayashi et al.
2004/0119012 A1 6/2004 Vestal
2004/0144918 A1 7/2004 Zare et al.
2004/0155187 A1 8/2004 Axelsson
2004/0159782 A1 8/2004 Park
2004/0183007 A1 9/2004 Belov et al.
2005/0006577 A1 1/2005 Fuhrer et al.
2005/0040326 A1 2/2005 Enke
2005/0103992 A1 5/2005 Yamaguchi et al.
2005/0133712 A1 6/2005 Belov et al.
2005/0151075 A1 7/2005 Brown et al.
2005/0194528 A1 9/2005 Yamaguchi et al.
2005/0242279 A1 11/2005 Verentchikov
2005/0258364 A1 11/2005 Whitehouse et al.
2006/0169882 A1 8/2006 Pau et al.
2006/0214100 A1 9/2006 Verentchikov et al.
2006/0289746 A1 12/2006 Raznikov et al.
2007/0023645 A1 2/2007 Chernushevich
2007/0029473 A1 2/2007 Verentchikov
2007/0176090 A1 8/2007 Verentchikov
2007/0187614 A1 8/2007 Schneider et al.
2007/0194223 A1 8/2007 Sato et al.
2008/0049402 A1 2/2008 Han et al.
2008/0197276 A1 8/2008 Nishiguchi et al.
2008/0203288 A1 8/2008 Makarov et al.
2008/0290269 A1 11/2008 Saito et al.
2009/0090861 A1 4/2009 Willis et al.
2009/0114808 A1 5/2009 Bateman et al.
2009/0206250 A1 8/2009 Wollnik
2009/0250607 A1 10/2009 Staats et al.
2009/0272890 A1 11/2009 Ogawa et al.
2010/0001180 A1 1/2010 Bateman et al.
2010/0044558 A1* 2/2010 Sudakov ..... H01J 49/406
250/281
2010/0072363 A1 3/2010 Giles et al.
2010/0078551 A1 4/2010 Loboda
2010/0140469 A1 6/2010 Nishiguchi
2010/0193682 A1 8/2010 Golikov et al.
2010/0301202 A1 12/2010 Vestal
2011/0133073 A1 6/2011 Sato et al.
2011/0168880 A1 7/2011 Ristroph et al.
2011/0180702 A1 7/2011 Flory et al.
2011/0180705 A1 7/2011 Yamaguchi
2011/0186729 A1 8/2011 Verentchikov et al.
2012/0168618 A1 7/2012 Vestal
2012/0261570 A1 10/2012 Shvartsburg et al.
2013/0048852 A1 2/2013 Verenchikov
2013/0056627 A1 3/2013 Verenchikov
2013/0068942 A1 3/2013 Verenchikov
2013/0187044 A1 7/2013 Ding et al.
2013/0240725 A1 9/2013 Makarov
2013/0248702 A1 9/2013 Makarov
2013/0256524 A1 10/2013 Brown et al.
2013/0313424 A1 11/2013 Makarov et al.
2013/0327935 A1 12/2013 Wiedenbeck
2014/0054456 A1 2/2014 Kinugawa et al.
2014/0084156 A1 3/2014 Ristroph et al.
2014/0117226 A1 5/2014 Giannakopulos
2014/0138538 A1 5/2014 Hieftje et al.
2014/0183354 A1 7/2014 Moon et al.
2014/0191123 A1 7/2014 Wildgoose et al.
2014/0239172 A1 8/2014 Makarov
2014/0291503 A1* 10/2014 Shchepunov et al. .....
H01J 49/062
250/282
2014/0312221 A1 10/2014 Verenchikov et al.
2014/0361162 A1 12/2014 Murray et al.
2015/0028197 A1 1/2015 Grinfeld et al.
2015/0028198 A1* 1/2015 Grinfeld et al. .... H01J 49/4245
250/282
2015/0034814 A1 2/2015 Brown et al.
2015/0048245 A1 2/2015 Vestal et al.
2015/0060656 A1 3/2015 Ugarov

(56) References Cited

U.S. PATENT DOCUMENTS

| | | | | |
|---|---|---|---|---|
| 2015/0122986 | A1 | 5/2015 | Haase | |
| 2015/0194296 | A1 | 7/2015 | Verenchikov et al. | |
| 2015/0228467 | A1 | 8/2015 | Grinfeld et al. | |
| 2015/0279650 | A1 | 10/2015 | Verenchikov | |
| 2015/0294849 | A1 | 10/2015 | Makarov et al. | |
| 2015/0318156 | A1 | 11/2015 | Loyd et al. | |
| 2015/0364309 | A1 | 12/2015 | Welkie | |
| 2015/0380233 | A1 | 12/2015 | Verenchikov | |
| 2016/0005587 | A1 | 1/2016 | Verenchikov | |
| 2016/0035558 | A1* | 2/2016 | Verenchikov et al. | H01J 49/067 250/287 |
| 2016/0079052 | A1 | 3/2016 | Makarov | |
| 2016/0225598 | A1 | 8/2016 | Ristroph | |
| 2016/0225602 | A1 | 8/2016 | Ristroph et al. | |
| 2016/0240363 | A1 | 8/2016 | Verenchikov | |
| 2017/0016863 | A1 | 1/2017 | Verenchikov | |
| 2017/0025265 | A1 | 1/2017 | Verenchikov et al. | |
| 2017/0032952 | A1 | 2/2017 | Verenchikov | |
| 2017/0098533 | A1 | 4/2017 | Stewart et al. | |
| 2017/0229297 | A1 | 8/2017 | Green et al. | |
| 2017/0338094 | A1 | 11/2017 | Verenchikov et al. | |
| 2018/0144921 | A1 | 5/2018 | Hoyes et al. | |
| 2018/0315589 | A1 | 11/2018 | Oshiro | |
| 2018/0366312 | A1 | 12/2018 | Hamish et al. | |
| 2019/0237318 | A1 | 8/2019 | Brown | |
| 2020/0083034 | A1 | 3/2020 | Hoyes et al. | |
| 2020/0126781 | A1 | 4/2020 | Kovtoun | |
| 2020/0152440 | A1 | 5/2020 | Hoyes et al. | |
| 2020/0168447 | A1 | 5/2020 | Verenchikov | |
| 2020/0168448 | A1 | 5/2020 | Verenchikov et al. | |

FOREIGN PATENT DOCUMENTS

| | | | | |
|---|---|---|---|---|
| CN | 102131563 | A | 7/2011 | |
| CN | 201946564 | U | 8/2011 | |
| DE | 4310106 | C1 | 10/1994 | |
| DE | 10116536 | A1 | 10/2002 | |
| DE | 102015121830 | A1 | 6/2017 | |
| DE | 102019129108 | A1 | 6/2020 | |
| DE | 112015001542 | B4 | 7/2020 | |
| EP | 0237259 | A2 | 9/1987 | |
| EP | 1137044 | A2 | 9/2001 | |
| EP | 1566828 | A2 | 8/2005 | |
| EP | 1901332 | A1 | 3/2008 | |
| EP | 2068346 | A2 | 6/2009 | |
| EP | 1665326 | B1 | 4/2010 | |
| EP | 1789987 | A4 | 9/2010 | |
| EP | 1522087 | B1 | 3/2011 | |
| EP | 2599104 | A1 | 6/2013 | |
| EP | 1743354 | B1 | 8/2019 | |
| EP | 3662501 | A1 | 6/2020 | |
| EP | 3662502 | A1 | 6/2020 | |
| EP | 3662503 | A | 6/2020 | |
| GB | 2080021 | A | 1/1982 | |
| GB | 2217907 | A | 11/1989 | |
| GB | 2300296 | A | 10/1996 | |
| GB | 2390935 | A | 1/2004 | |
| GB | 2396742 | A | 6/2004 | |
| GB | 2403063 | A | 12/2004 | |
| GB | 2396742 | B * | 12/2005 | H01J 49/408 |
| GB | 2455977 | A | 7/2009 | |
| GB | 2476964 | A | 7/2011 | |
| GB | 2478300 | A | 9/2011 | |
| GB | 2484361 | B | 5/2012 | |
| GB | 2484429 | B | 6/2012 | |
| GB | 2489094 | A | 9/2012 | |
| GB | 2490571 | A | 11/2012 | |
| GB | 2562990 | A | 12/2012 | |
| GB | 2495127 | A | 4/2013 | |
| GB | 2495221 | A | 4/2013 | |
| GB | 2496991 | A | 5/2013 | |
| GB | 2496994 | A | 5/2013 | |
| GB | 2500743 | A | 10/2013 | |
| GB | 2501332 | A | 10/2013 | |
| GB | 2506362 | A | 4/2014 | |
| GB | 2528875 | A | 2/2016 | |
| GB | 2555609 | A | 5/2018 | |
| GB | 2556451 | A | 5/2018 | |
| GB | 2556830 | A | 6/2018 | |
| GB | 2575157 | A | 1/2020 | |
| GB | 2575339 | A | 1/2020 | |
| JP | S6229049 | A | 2/1987 | |
| JP | 2000036285 | A | 2/2000 | |
| JP | 2000048764 | A | 2/2000 | |
| JP | 2003031178 | A | 1/2003 | |
| JP | 3571546 | B2 | 9/2004 | |
| JP | 2005538346 | A | 12/2005 | |
| JP | 2006049273 | A | 2/2006 | |
| JP | 2007227042 | A | 9/2007 | |
| JP | 2010062152 | A | 3/2010 | |
| JP | 4649234 | B2 | 3/2011 | |
| JP | 2011119279 | A | 6/2011 | |
| JP | 4806214 | B2 | 11/2011 | |
| JP | 2013539590 | A | 10/2013 | |
| JP | 5555582 | B2 | 7/2014 | |
| JP | 2015506567 | A | 3/2015 | |
| JP | 2015185306 | A | 10/2015 | |
| RU | 2564443 | C2 | 10/2015 | |
| RU | 2015148627 | A | 5/2017 | |
| RU | 2660655 | C2 | 7/2018 | |
| SU | 198034 | A1 | 9/1991 | |
| SU | 1681340 | A1 | 9/1991 | |
| SU | 1725289 | A1 | 4/1992 | |
| WO | 9103071 | A1 | 3/1991 | |
| WO | 9801218 | A1 | 1/1998 | |
| WO | 98008244 | A2 | 2/1998 | |
| WO | 0077823 | A2 | 12/2000 | |
| WO | 2005001878 | A2 | 1/2005 | |
| WO | 2006049623 | A2 | 5/2006 | |
| WO | 2006102430 | A2 | 9/2006 | |
| WO | 2007044696 | A1 | 4/2007 | |
| WO | 2007104992 | A2 | 9/2007 | |
| WO | 2007136373 | A1 | 11/2007 | |
| WO | 2008046594 | A2 | 4/2008 | |
| WO | 2008087389 | A2 | 7/2008 | |
| WO | 2010008386 | A1 | 1/2010 | |
| WO | 2010138781 | A2 | 12/2010 | |
| WO | 2011086430 | A1 | 7/2011 | |
| WO | 2011107836 | A1 | 9/2011 | |
| WO | 2011135477 | A1 | 11/2011 | |
| WO | 2012010894 | A1 | 1/2012 | |
| WO | 2012023031 | A2 | 2/2012 | |
| WO | 2012024468 | A2 | 2/2012 | |
| WO | 2012024570 | A2 | 2/2012 | |
| WO | 2012116765 | A1 | 9/2012 | |
| WO | 2013045428 | A1 | 4/2013 | |
| WO | 2013063587 | A2 | 5/2013 | |
| WO | 2013067366 | A2 | 5/2013 | |
| WO | 2013093587 | A1 | 6/2013 | |
| WO | 2013098612 | A1 | 7/2013 | |
| WO | 2013110587 | A2 | 8/2013 | |
| WO | 2013110588 | A2 | 8/2013 | |
| WO | 2013124207 | A | 8/2013 | |
| WO | 2014021960 | A1 | 2/2014 | |
| WO | 2014074822 | A1 | 5/2014 | |
| WO | 2014110697 | A1 | 7/2014 | |
| WO | 2014142897 | A1 | 9/2014 | |
| WO | 2015142897 | A1 | 9/2015 | |
| WO | 2015152968 | A1 | 10/2015 | |
| WO | 2015153622 | A1 | 10/2015 | |
| WO | 2015153630 | A1 | 10/2015 | |
| WO | 2015153644 | A1 | 10/2015 | |
| WO | 2015175988 | A1 | 11/2015 | |
| WO | 2016064398 | A1 | 4/2016 | |
| WO | 2016174462 | A1 | 11/2016 | |
| WO | 2018073589 | A1 | 4/2018 | |
| WO | 2018109920 | A1 | 6/2018 | |
| WO | 2018124861 | A2 | 7/2018 | |
| WO | 2019030472 | A1 | 2/2019 | |
| WO | 2019030475 | A1 | 2/2019 | |
| WO | 2019030476 | A1 | 2/2019 | |
| WO | 2019030477 | A1 | 2/2019 | |

(56) References Cited

FOREIGN PATENT DOCUMENTS

| | | | |
|---|---|---|---|
| WO | 2019058226 | A1 | 3/2019 |
| WO | 2019162687 | A1 | 8/2019 |
| WO | 2019202338 | A1 | 10/2019 |
| WO | 2019229599 | A1 | 12/2019 |
| WO | 2020002940 | A1 | 1/2020 |
| WO | 2020021255 | A1 | 1/2020 |
| WO | 2019030474 | A1 | 6/2020 |
| WO | 2020121167 | A1 | 6/2020 |
| WO | 2020121168 | A1 | 6/2020 |

OTHER PUBLICATIONS oyoda (Toyoda et al, "Multi-Turn Time-of-Flight Mass Spectrometers with Electrostatic Sectors", J. Mass Spectrom; 2003; 38, 1125-1142) (Year: 2003).*

Sakurai et al, "A New Multi-Passage Time of Flight Mass Spectonneter at JAIST" Nuclear Instruments and Methods in Physics Research A 427 (1999), 182-186 (Year: 1999).*

Toyoda et al., "Multi-Turn Time of Flight Mass Spectrometers with Electrostatic Sectors", J. Mass Spectrom; 2003, 38, 1125-1142 (Year: 2003).*

International Search Report and Written Opinion for International Application No. PCT/EP2017/070508 dated Oct. 16, 2017, 18 pages.

Search Report for United Kingdom Application No. GB1613988.3 dated Jan. 5, 2017, 5 pages.

Sakurai et al., "A New Multi-Passage Time-of-Flight Mass Spectrometer at JAIST", Nuclear Instruments & Methods in Physics Research, Section A, Elsevier, 427(1-2): 182-186, May 11, 1999.

Toyoda et al., "Multi-Turn-Time-of-Flight Mass Spectometers with Electrostatic Sectors", Journal of Mass Spectrometry, 38: 1125-1142, Jan. 1, 2003.

Nouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.

International Search Report and Written Opinion for International Application No. PCT/US2016/062174 dated Mar. 6, 2017, 8 pages.

IPRP PCT/US2016/062174 dated May 22, 2018, 6 pages.

Search Report for GB Application No. GB1520130.4 dated May 25, 2016.

International Search Report and Written Opinion for International Application No. PCT/US2016/062203 dated Mar. 6, 2017, 8 pages.

Search Report for GB Application No. GB1520134.6 dated May 26, 2016.

IPRP PCT/US2016/062203, dated May 22, 2018, 6 pages.

Search Report Under Section 17(5) for Application No. GB1507363.8 dated Nov. 9, 2015.

International Search Report and Written Opinion of the International Search Authority for Application No. PCT/GB2016/051238 dated Jul. 12, 2016, 16 pages.

IPRP for application PCT/GB2016/051238 dated Oct. 31, 2017, 13 pages.

International Search Report and Written Opinion for International Application No. PCT/US2016/063076 dated Mar. 30, 2017, 9 pages.

Search Report for GB Application No. 1520540.4 dated May 24, 2016.

IPRP for application PCT/US2016/063076, dated May 29, 2018, 7 pages.

IPRP PCT/GB17/51981 dated Jan. 8, 2019, 7 pages.

International Search Report and Written Opinion for International Application No. PCT/GB2018/051206, dated Jul. 12, 2018, 9 pages.

Author unknown, "Electrostatic lens," Wikipedia, Mar. 31, 2017 (Mar. 31, 2017), XP055518392, Retrieved from the Internet URL https://en.wikipedia.org/w/index.phptitle=Electrostaticlens oldid=773161674[retrieved on Oct. 24, 2018].

Hussein, O.A. et al., "Study the most favorable shapes of electrostatic quadrupole doublet lenses", AIP Conference Proceedings, vol. 1815, Feb. 17, 2017 (Feb. 17, 2017), p. 110003.

Guan S., et al., "Stacked-ring electrostatic ion guide", Journal of the American Society for Mass Spectrometry, Elsevier Science Inc, 7(1)101-106 (1996).

Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.

International Search Report and Written Opinion for application No. PCT/GB2018/052104, dated Oct. 31, 2018, 14 pages.

International Search Report and Written Opinion for application No. PCT/GB2018/052105, dated Oct. 15, 2018, 18 pages.

International Search Report and Written Opinion for application PCT/GB2018/052100, dated Oct. 19, 2018, 19 pages.

International Search Report and Written Opinion for application PCT/GB2018/052102, dated Oct. 25, 2018, 14 pages.

International Search Report and Written Opinion for application No. PCT/GB2018/052099, dated Oct. 10, 2018, 16 pages.

International Search Report and Written Opinion for application No. PCT/GB2018/052101, dated Oct. 19, 2018, 15 pages.

Combined Search and Examination Report under Sections 17 and 18(3) for application GB1807605.9, dated Oct. 29, 2018, 6 pages.

Combined Search and Examination Report under Sections 17 and 18(3) for application GB1807626.5, dated Oct. 29, 2018, 8 pages.

Yavor, M.I., et al., "High performance gridless ion mirrors for multi-reflection time-of-flight and electrostatic trap mass analyzers", International Journal of Mass Spectrometry, vol. 426, Mar. 2018, pp. 1-11.

Search Report under Section 17(5) for application GB1707208.3, dated Oct. 12. 2017, 6 pages.

Communication Relating to the Results of the Partial International Search for International Application No. PCT/GB2019/01118, dated Jul. 19, 2019, 25 pages.

Doroshenko, V.M., and Cotter, R.J., "Ideal velocity focusing in a reflectron time-of-flight mass spectrometer", American Society for Mass Spectrometry, 10(10):992-999 (1999).

Kozlov, B. et al. "Enhanced Mass Accuracy in Multi-Reflecting Tof MS" www.Waters.Com/Posters, ASMS Conference (2017).

Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.

Kozlov, B. et al. "High accuracy self-calibration method for high resolution mass spectra" ASMS Conference Abstract, 2019.

Kozlov, B. et al. "Fast Ion Mobility Spectrometry and High Resolution TOF MS" ASMS Conference Poster (2014).

Verenchicov, A. N. "Parallel MS-MS Analysis in a Time-Flight Tandem. Problem Statement, Method, and Instrumental Schemes" Institute for Analytical Instrumentation RAS, Saint-Petersburg, (2004).

Yavor, M. I. "Planar Multireflection Time-of-Flight Mass Analyzer with Unlimited Mass Range" Institute for Analytical Instrumentation RAS, Saint-Petersburg, (2004).

Khasin, Y. I. et al., "Initial Experimental Studies of a Planar Multireflection Time-of-Flight Mass Spectrometer" Institute for Analytical Instrumentation RAS, Saint-Petersburg, (2004).

Verenchicov, A. N. et al. "Stability of Ion Motion in Periodic Electrostatic Fields" Institute for Analytical Instrumentation RAS, Saint-Petersburg, (2004).

Verenchicov, A. N. "The Concept of Multireflecting Mass Spectrometer for Continuous Ion Sources" Institute for Analytical Instrumentation RAS, Saint-Petersburg, (2006).

Verenchicov, A. N., et al. "Accurate Mass Measurements for Interpreting Spectra of atmospheric Pressure Ionization" Institute for Analytical Instrumentation RAS, Saint-Petersburg, (2006).

Kozlov, B. N. et al., "Experimental Studies of Space Charge Effects in Multireflecting Time-of-Flight Mass Spectrometes" Institute for Analytical Instrumentation RAS, Saint-Petersburg, (2006).

Kozlov, B. N. et al., "Multireflecting Time-of-Flight Mass Spectrometer With an Ion Trap Source" Institute for Analytica nstrumentation RAS, Saint-Petersburg, (2006).

(56) References Cited

OTHER PUBLICATIONS

Hasin, Y. I., et al., " Planar Time-of-Flight Multireflecting Mass Spectrometer with an Orthogonal Ion Injection Out of Continuous Ion Sources" Institute for Analytical Instrumentation RAS, Saint-Petersburg, (2006).
Lutvinsky, Y. I., et al., "Estimation of Capacity of High Resolution Mass Spectra for Analysis of Complex Mixtures" Institute for Analytical Instrumentation RAS, Saint-Petersburg, (2006).
Wikipedia "Reflectron", Oct. 9, 2015, Retrieved from the Internet URL https://en.wikipedia.org/w/index.php?title=Reflectron&oldid=684843442 [retrieved on May 29, 2019].
Verenchicov., A. N. et al. "Multiplexing in Multi-Reflecting TOF MS" Journal of Applied Solution Chemistry and Modeling, 6:1-22 (2017).
Supplementary Partial EP Search Report for EP Application No. 16869126.9, dated Jun. 13, 2019.
Supplementary Partial EP Search Report for EP Application No. 16866997.6, dated Jun. 7, 2019.
Extended European Search Report for EP Patent Application No. 16866997.6 dated Oct. 16, 2019.
International Search Report and Written Opinion for International Application No. PCT/GB2019/051234 dated Jul. 29, 2019.
International Search Report and Written Opinion for International Application No. PCT/GB2019/051839 dated Sep. 18, 2019.
International Search Report and Written Opinion for International Application No. PCT/GB20180051320 dated Aug. 1, 2018.
Stresau, D., et al., "Ion Counting Beyond 10ghz Using a New Detector and Conventional Electronics", European Winter Conference on Plasma Spectrochemistry, Feb. 4-8, 2001, Lillehammer, Norway, Retrieved from the Internet URL https://www.etp-ms.com/file-repository/21 [retrieved on Jul. 31, 2019].
Kaufmann, R., et. al., "Sequencing of peptides in a time-of-flight mass spectrometer: evaluation of postsource decay following matrix-assisted laser desorption ionisation (MALDI)", International Journal of Mass Spectrometry and Ion Processes, Elsevier Scientific Publishing CO. Amsterdam, NL, 131:355-385, Feb. 24, 1994.
Shaulis, Barry, et al., "Signal linearity of an extended range pulse counting detector: Applications to accurate and precise U-Pb dating of zircon by laser ablation quadrupole ICP-MS", G3: Geochemistry, Geophysics, Geosystems, 11(11):1-12, Nov. 20, 2010.
Search Report for United Kingdom Application No. GB1708430.2 dated Nov. 28, 2017.
International Search Report and Written Opinion for International application No. PCT/GB2020/050209, dated Apr. 28, 2020, 12 pages.
Search Report under Section 17(5) for GB1916445.8, dated Jun. 15, 2020.
Author unknown, "Einzel Lens", Wikipedia [online]Nov. 2020 [retrieved on Nov. 3, 2020]. Retrieved from Internet URL: https://en.wikipedia.org/wiki/Einzel_lens, 2 pages.
Combined Search and Examination Report for United Kingdom Application No. GB1901411.7 dated Jul. 31, 2019.
Examination Report for United Kingdom Application No. GB1618980.5 dated Jul. 25, 2019.
Combined Search and Examination Report for GB 1906258.7, dated Oct. 25, 2019.
Combined Search and Examination Report for GB1906251.8, dated Oct. 30, 2019.
IPRP for International application No. PCT/GB2018/051206, dated Nov. 5, 2019, 7 pages.
International Search Report and Written Opinion for Intemational application No. PCT/GB2019/051235, dated Sep. 25, 2019, 22 pages.
International Search Report and Written Opinion for International application No. PCT/GB2019/051416, dated Oct. 10, 2019, 22 pages.
Search and Examination Report under Sections 17 and 18(3) for Application No. GB1906258.7, dated Dec. 11, 2020, 7 pages.
Wollnik, H., and Casares, A., "An energy-isochronous multi-pass time-of-flight mass spectrometer consisting of two coaxial electrostatic mirrors", International Journal of Mass Spectrometry, 227(2):217-222 (2003).
Carey, D.C., "Why a second-order magnetic optical achromat works", Nucl. Instrum. Meth., 189(2-3):365-367 (1981).
Sakurai, et al., "Ion optics for time-of-flight mass spectrometers with multiple symmetry", Int J Mass Spectrom Ion Proc 63(2-3):273-287 (1985).

* cited by examiner

MASS ANALYSER HAVING EXTENDED FLIGHT PATH

CROSS-REFERENCE TO RELATED APPLICATION

This application is a national phase filing claiming the benefit of and priority to International Patent Application No. PCT/EP2017/070508, filed on Aug. 11, 2017, which claims priority from and the benefit of United Kingdom patent application No. 1613988.3 filed on Aug. 16, 2016. The entire contents of these applications are incorporated herein by reference.

FIELD OF THE INVENTION

The present invention relates generally to mass spectrometers and in particular to folded flight path (FFP) spectrometers comprising electrostatic sectors.

BACKGROUND

Time-of-flight (TOF) mass spectrometers having a folded flight path (FFP) for the ions are known. These are promising instruments for achieving high mass resolution at high sensitivity and high speed of analysis. There are two main types of folded flight path TOF mass spectrometers. One type comprises two opposing ion mirrors and reflects the ions between the ion mirrors multiple times so as to provide a relatively long flight path length for the ions in a relatively small size instrument. GB 2080021 and SU 1725289 disclose examples of such instruments.

Another type of folded flight path TOF mass spectrometer comprises electrostatic sectors for bending the flight path of the ions so that a relatively long flight path can be provided in a relatively small instrument. Sakurai et al (Nucl. Instrum. Meth. A427, 1999, 182-186) and Toyoda et al (J. Mass Spectrom. 38, 2003, 1125-1142) disclose examples of such instruments.

It may be preferred to use sector-based folded flight path TOF mass spectrometers rather than ion mirror based instruments, because sector-based instruments need not have ion reflecting regions and thus may provide an order of magnitude higher space-charge tolerance. Also, sector-based instruments are able to use fewer power supplies.

On the other hand, it may be preferred to use ion mirror based folded flight path TOF mass spectrometers rather than sector-based instruments, because ion mirrors provide relatively high order time per energy focusing and thus provide the instrument with a relatively high energy acceptance. This may be important, for example, when analyzing ions from some pulsed ion sources. In contrast, conventional sector-based instruments possess only first order time per energy focusing, thus inhibiting use of sector-based analyzers in combination with some ion sources and high-field pulsed ion converters.

Another drawback of conventional sector-based folded flight path TOF mass spectrometers is that they have a relatively small spatial acceptance, i.e. the product of the accepted packet size and divergence angle is relatively small. This is especially restrictive for some instruments, for example, when used in combination with pulsed linear ion trap converters in which the phase space of the ion beam may reach 10 mm×mrad or more, even after accelerating the ions to relatively high energy.

Also, conventional sector-based folded flight path TOF mass spectrometers possess only first order time of flight focusing with respect to the spatial spread in the plane of ion deflection. In other words, the term 'isochronous ion transport' typically used when describing ion-optical properties of sector-based folded flight path TOF mass spectrometers, in practice, always means first order isochronous ion transport, e.g., as described by Sakurai et al (Int. J. Mass Spectrom. Ion Proc., 63, 1985, 273-287).

Another drawback of sector-based folded flight path TOF mass spectrometers is that they require relatively complex devices for ion confinement in the direction orthogonal to the plane of the curved mean ion trajectory. Conventional systems employ either toroidal sector fields or complex quadrupolar lenses. In addition to these devices being complex, they prevent operation of the instrument in many useful modes that would increase sensitivity and mass resolving power. For example, such sectors prevent the operation in an 'open trap' mode as described in US 2013/056627 or with reversing direction of drift in the direction perpendicular to deflection plane, similar to that disclosed in U.S. Pat. No. 5,017,780 for mirror-type sector-based folded flight path TOF mass spectrometers.

Thus, there is a need for development of simpler and less expensive sector-based folded flight path TOF mass spectrometers with increased spatial and energy acceptance and improved mass resolving power.

The present invention provides an improved mass analyser and an improved method of mass spectrometry.

SUMMARY

The present invention provides a time-of-flight or electrostatic trap mass analyzer comprising:

an ion flight region comprising a plurality of ion-optical elements for guiding ions through the flight region in a deflection (x-y) plane;

wherein said ion-optical elements are arranged so as to define a plurality of identical ion-optical cells;

wherein the ion-optical elements in each ion-optical cell are arranged and configured so as to generate electric fields for either focusing ions travelling in parallel at an ion entrance location of the cell to a point at an ion exit location of the cell, or for focusing ions diverging from a point at the ion entrance location to travel parallel at the ion exit location;

wherein each ion-optical cell comprises a plurality of electrostatic sectors having different deflection radii for bending the flight path of the ions in the deflection (x-y) plane;

wherein the ion-optical elements in each cell are configured to generate electric fields that either (i) have mirror symmetry in the deflection plane about a line in the deflection plane that is perpendicular to a mean ion path through the cell at a point half way along the mean ion path through the cell, or (ii) have point symmetry in the deflection plane about a point in the deflection plane that is half way along the mean ion path through the cell; and wherein the ion-optical elements are arranged and configured such that, in the frame of reference of the ions, the ions are guided through the deflection plane in the ion-optical cells along mean flight paths that are of the same shape and length in each ion-optical cell.

The inventors have recognized that using a novel combination of ion-optical symmetry, focusing conditions and electrostatic sectors having different deflection radii provides the analyzer with second order spatial isochronicity, thus providing the instrument with a relatively high spatial acceptance (i.e. the product of the accepted packet size and divergence angle is relatively large). The inventors have also realized that this provides second order energy isochronicity, thus considerably increasing their energy acceptance of the instrument. This allows the instrument to use, for example, pulsed ion sources and high-field pulsed ion converters. Embodiments provide instruments with full second order time of flight focusing with respect to the spatial spread in the deflection plane.

Sakurai et al (Nucl. Instrum. Meth. A427, 1999, 182-186) disclose a folded flight path TOF mass spectrometer comprising ion-optical elements, including electrostatic sectors. However, the ion-optical elements are not arranged in ion-optical cells, wherein each cell is capable of parallel-to-point or point-to-parallel focussing. Also, the electrostatic sectors do not have different deflection radii. As such, the analyser of Sakurai et al cannot provide the advantages of the present invention.

The skilled person will appreciate that the geometry of the ion-optical elements in the embodiments of the electrostatic sector analyser described herein defines the operating characteristics of the analyser, i.e. to achieve at least first order isochronicity in any given embodiment of the analyser, a unique set of electrical potentials must be applied to the analyser (i.e. there is single operational voltage set, rather than a plurality of sets). The geometry thus automatically defines the functions described above (e.g. repetitive cells, symmetry of the cells, and point-to-parallel and parallel-to-point focussing). For example, the deflection radii of the sectors, the angle through which each ion-optical element deflects ions, and the free flight path between adjacent ion-optical elements defines the operating characteristics of the analyser and also the voltages that must be applied to the ion-optical elements to achieve the functions described herein. The same deterministic principle linking the geometry, the voltages and the properties of sector analysers provides sufficient information for synthesis of the isochronous sector analyser based on the herein described ion optical principles. Thus, a person skilled in ion optics is capable of synthesising the proper sector system with second order isochronicity based on the principles described herein of repetitive ion cells, ion cell symmetry, parallel-to-point focusing, while using sectors with different radii. Since the principle allows synthesising a multiplicity of second order isochronous systems, we consider the set of ion optical principles as the only correct way for describing ion optics of the second order isochronous analyser.

According to the embodiments of the present invention, the ion-optical elements comprise voltage supplies and are connected to a controller. The controller and voltage supplies are set up and configured to apply voltages to the ion-optical elements so as to perform the functions described herein.

The ions may be deflected by the ion-optical elements in a substantially circular or oval loop in the deflection (x-y) plane.

The ions may be deflected by the ion-optical elements in a closed loop in the deflection (x-y) plane.

The parallel-to-point focusing, or point-to-parallel focusing, may be focusing to the first order approximation.

The analyser may be arranged and configured such that ions enter a first of the ion-optical cells as a parallel beam at the ion entrance location, or diverging from a point at the ion entrance location (to a first order approximation).

It will be appreciated that the ion entrance location and/or ion exit location of any given ion-optical cell need not correspond to a physical aperture or other physical structure, but is/are location(s) defined by the focusing of the ion optical elements in that cell (i.e. the point-to parallel or parallel-to-point focusing).

The ion-optical elements may be arranged and configured such that the ions are transmitted directly from one ion-optical cell to the next ion-optical cell. In other words, the ion exit location of any given ion-optical cell corresponds to the ion entrance location of the adjacent downstream ion-optical cell. The exit location of that downstream ion-optical cell may correspond to the ion entrance location of an ion-optical cell arranged adjacent and downstream thereof.

The analyzer may comprise only two of said ion-optical cells. Ions may be transmitted between and through these ion-optical cells only once, or a plurality of times. Alternatively, the analyzer may comprise more than two of said ion-optical cells. Ions may be transmitted between and through these ion-optical cells only once, or a plurality of times.

The ion-optical elements may be arranged and configured such that said ions travel through said ion-optical cells such that they are subjected to one or more cycle, wherein each cycle comprises either: (i) said parallel-to-point focusing by one of said cells and then said point-to-parallel focusing by another successive one of said cells; or (ii) said point-to-parallel focusing by one of said cells and then said parallel-to-point focusing by another successive one of said cells.

The ion-optical elements may be arranged and configured such that said ions are subjected to an even, integer number of said cycles.

The ion-optical elements may be arranged and configured such that, in use, said ions pass through each of said ion-optical cells in a spatially achromatic and/or energy isochronous mode to a first order approximation.

Each of said ion-optical cells may comprise at least three electrostatic sectors having at least two different deflection radii.

The mean ion path through a sector forms part of a circumference of a circle and the deflection radius of a sector is the radius defined by that circle.

The ion-optical elements may be arranged and configured in any given ion-optical cell such that for ions entering the cell as a parallel beam, the flight time of these ions through the cell is independent, to the second order approximation, of the distance of the ions from a beam ion-optic axis on entering the cell, at least in the deflection (x-y) plane.

The ion-optical elements may be arranged and configured in any given ion-optical cell so as to provide second order focusing of ion flight time with respect to energy spread in ion bunches passing through the cell.

More specifically, the ratios of sector deflection radii, sector deflection angles and sector focusing fields may be tuned to provide second order focusing of the flight time with respect to energy spread in ion bunches passing through the cell.

The electrostatic sectors may be configured to generate two-dimensional electrostatic fields for deflecting the ions in the deflection plane, wherein the fields generated by the sectors are independent of any electric fields in the direction perpendicular to the deflection plane.

The electrostatic sectors may be cylindrical sectors.

The analyser may comprise an ion accelerator for accelerating ions into the flight region and/or an ion detector for detecting ions exiting the flight region.

The analyser may comprise a drift electrode arranged and configured to cause ions to drift through the analyzer in a drift (z–) dimension perpendicular to the deflection (x-y) plane as the ions travel through the ion-optical elements.

The drift electrode may pulse ions into said flight region. The drift electrode may form at least part of an ion accelerator that accelerates ions into the flight region.

The inventors have realized that due to the significant reduction of flight time aberrations provided by the embodiments described herein, the time spread of the ion source may become a major limiting factor in the resolving power of the instrument. A relatively long flight path may be used, together with a device to avoid ion packet spreading, to overcome this.

The ion-optical elements may be arranged and configured to cause the ions to have a looped flight path in the deflection plane and to perform a plurality of loops in the deflection plane; and the analyzer may comprise one or more drift lens arranged in the flight region so that the ions pass through the one or more drift lens as the ions loop around the deflection plane, and the one or more drift lens may be configured to focus the ions in the drift (z–) dimension so as to limit the divergence of the ions in said drift dimension as they drift along the drift dimension.

The analyser may comprise a plurality of said drift lenses spaced along said drift dimension.

The plurality of said drift lenses may be arranged in a periodic array in the drift dimension.

Each of the drift lenses may be an electrostatic lens and/or may be a 2D lens.

Each of the drift lenses may focus the ions in the drift dimension in a manner that is independent of ion focusing in the deflection plane or may be configured to generate electric fields that are quadrupolar in the plane orthogonal to the deflection plane.

Each of the drift lenses may be one of: (i) a 2D lens arranged and configured so that to perform no focusing in the deflection (x-y) plane; (ii) a quadrupole lens; (iii) a combination of 2D and quadrupole lenses.

The drift lenses may be coaxial in the deflection plane.

The drift lens(es) may be arranged between sectors or may be a locally z-focusing field within at least one of the sectors.

The drift electrode may cause the ions to drift in a linear (z–) drift direction.

Alternatively, the analyzer may be arranged and configured such that the drift electrode pulses the ions to drift along a curved, e.g. circular, drift path.

The drift electrode may be arranged on a first side, in the drift (z–) dimension, of the ion-optical elements and the ion detector may be arranged on a second opposite side, in said drift dimension, of the ion-optical elements.

Alternatively, the drift electrode and ion detector may be arranged on a first side, in the drift dimension, of the ion-optical elements and one or more reflector electrode may be arranged on a second opposite side, in said drift dimension, of the ion-optical elements; wherein said reflector electrode is configured to reflect ions back in the drift dimension towards the detector.

One or more reflector electrode may be arranged on each side, in the drift dimension, of the ion-optical elements and may be configured to reflect the ions along the drift dimension as the ions pass through the ion-optical elements.

The reflector electrode(s) described herein enable ions to travel multiple times along the drift dimension, thus increasing the flight path of the ions in the analyzer and enabling higher resolving powers. The reflector electrode(s) may be supplied by a continuous or pulsed power supply.

The reflector electrode(s) described herein may be arranged and configured so as not to change the spatial focusing properties of the analyzer in the deflection (x-y) plane. However, the z-fields may affect the flight time of the ions and thus allow tuning the position of the time focus of the analyzer, i.e. may provide additional flexibility in tuning of the sector fields in the x-y deflection plane.

The drift lens(es) and reflector electrode(s) described herein do not significantly limit the resolving power of the instrument but provide significant ion flight path extension, thus compensating for higher turn-around times in an ion source, at limited energy acceptance of the analyzer.

The analyser may comprise a pulsed ion source or pulsed ion accelerator for pulsing ions into the ion-optical elements.

The relatively high spatial acceptance of the instrument enables it to be used with pulsed ion sources or pulsed ion accelerators. The pulsed ion source or ion accelerator may be any one of: a MALDI ion source; a DE MALDI ion source; a SIMS ion source; a radiofrequency axial or linear ion trap; or an orthogonal ion accelerator for accelerating ions orthogonally. For example, MALDI, SIMS, or radio frequency linear ion traps (LITs) produce ion packets with relatively low energy spreads (e.g., from 10 to 100 eV) which are particularly suitable for sector-based folded flight path TOF mass spectrometers at high transport energies, e.g., above 10 keV.

The ion accelerator may pulse ions towards a detector in a series of ion accelerator pulses, wherein the timings of the pulses are determined by an encoding sequence that varies the duration of the time interval between adjacent pulses as the series of pulses progresses; and wherein the analyser comprises a processor configured to use the timings of the pulses in the encoding sequence to determine which ion data detected at the detector relate to which ion accelerator pulse so as to resolve spectral data obtained from the different ion accelerator pulses. The ion accelerator may be configured to pulse ions towards the detector at a rate such that some of the ions pulsed towards the detector in any given pulse arrive at the detector after some of the ions that are pulsed towards the detector in a subsequent pulse. The use of the encoding sequence (i.e. an encoded frequency pulsing method) enables ions to be injected into the flight region of the analyser at time intervals that are shorter than the ion separation time in the flight region and so enables the duty cycle of the analyser to be increased.

Each of the electrostatic sectors may be a cylindrical sector having its axis of cylindrical rotation aligned in the dimension orthogonal to the deflection (x-y) plane.

The analyser may be one of:

(i) a time-of-flight mass analyzer comprising an ion accelerator for pulsing ions into said flight region and an ion detector, wherein said flight region is arranged between said ion accelerator and detector such that ions separate according to mass to charge ratio in the flight region;

(ii) an open trap mass analyzer configured such that ions enter a first end of the flight region and exit the flight region at a second, opposite end;

(iii) an electrostatic trap mass analyzer having an image current detector for detecting ions; or (iv) an electrostatic trap mass analyzer having an ion detector arranged for detecting only a portion of the ions passing the detector.

For example, the analyzer may be an open trap mass analyser (e.g. of the type described ion WO 2011/107836) that injects ions into the analyser at one end such that the ions drift through the analyser in a z-direction orthogonal to the deflection (x-y) plane and exit the analyzer at the other end (in the z-direction) onto an ion detector. The analyser may not include drift lenses that focus the ions in the drift z-dimension (for limiting the divergence of the ions in said drift z-dimension) as they drift along the drift z-dimension. The ions may diverge in the z-dimension as they travel through the analyzer in the deflection (x-y) plane and towards the detector, and so ions may have performed different numbers of loops around the deflection (x-y) plane by the time that they reach the detector. The detector may therefore see several signals at different times for ions of the same mass to charge ratio from the same ion packet. The spectra may be interpreted using a Fourier transform technique or a multi-start encoded frequency pulsing technique (e.g. as described in WO 2011/135477).

It is also contemplated that the analyser may be an electrostatic trap mass analyzer having an image current detector for detecting ions (e.g. of the type disclosed in WO 2011/086430). The image current detector comprises at least one detection electrode and detection electronics configured to detect a current induced in the detection electrode due to ions passing proximate the detection electrode. For example, the detection electrode may be a plate electrode, or may be a tubular electrode through which the ions pass. The analyser is configured such that the ions repeatedly pass the detection electrode. The image current detector may determine, from the current induced in the detection electrode, the frequency with which ions pass the detection electrode. The analyser may then determine the mass to charge ratio of ions from the determined frequency that the ions pass the detection electrode. If ions of different mass to charge ratios are present, the different ions will pass the detection electrode with different frequencies and will induce time varying currents in the detection electrode that have different periodic frequencies. The mass to charge ratios of the different ions can be determined by determining the different periodic frequencies of the currents. As described in the above embodiments, ions may be confined and reflected in the z-direction of the analyser and so may be trapped indefinitely.

It is also contemplated that the analyser may be an electrostatic trap mass analyzer having an ion detector arranged for detecting only a portion of the ions passing the detector. The detector comprises at least one detection electrode and detection electronics configured to detect ions striking the detection electrode. The analyser is configured such that ions are repeatedly directed passed or through the detection electrode, but such that during each pass some of the ions strike the detector electrode. For example, the detection electrode may comprise a mesh or a plurality of wires through which the ions are repeatedly directed. On each pass some of the ions strike the detector electrode and the detector may determine, from the current generated in the detection electrode due to the ions striking it, the frequency with which ions pass the detection electrode. The analyser may then determine the mass to charge ratio of these ions from the determined frequency that the ions pass the detection electrode. If ions of different mass to charge ratios are present, the different ions will pass the detection electrode with different frequencies and will cause time varying currents in the detection electrode that have different periodic frequencies. The mass to charge ratios of the different ions can be determined by determining the different periodic frequencies of the currents. As described in the above embodiments, ions may be confined and reflected in the z-direction of the analyser and so may be trapped indefinitely (other than striking the detection electrode).

The present invention also provides a mass spectrometer comprising an analyzer as described herein.

The present invention also provides a method of time of flight or electrostatic trap mass analysis comprising:

transmitting ions through a flight region comprising a plurality of ion-optical elements that guide the ions in a deflection (x-y) plane;

wherein said ion-optical elements are arranged so as to define a plurality of identical ion-optical cells;

wherein the ion-optical elements in each ion-optical cell generate electric fields that either focus ions travelling in parallel at an ion entrance location of the cell to a point at an ion exit location of the cell, or focus ions diverging from a point at the ion entrance location to travel parallel at the ion exit location;

wherein each ion-optical cell comprises a plurality of electrostatic sectors having different deflection radii that bend the flight path of the ions in the deflection (x-y) plane;

wherein the ion-optical elements in each cell generate electric fields that either (i) have mirror symmetry in the deflection plane about a line in the deflection plane that is perpendicular to a mean ion path through the cell at a point half way along the mean ion path through the cell, or (ii) have point symmetry in the deflection plane about a point in the deflection plane that is half way along the mean ion path through the cell; and wherein the ion-optical elements guide the ions through the deflection plane in the ion-optical cells along mean flight paths that, in the frame of reference of the ions, are of the same shape and length in each ion-optical cell.

The method comprises applying voltages to the ion-optical elements so as to perform the functions described herein.

The method may comprise deflecting the ions, using the ion-optical elements, in a substantially circular or oval loop in the deflection (x-y) plane.

The ions may be deflected by the ion-optical elements in a closed loop in the deflection (x-y) plane.

Each of the ion-optical cells performs said parallel-to-point focusing, or point-to-parallel focusing, in the deflection plane. The parallel-to-point focusing, or point-to-parallel focusing, may be to the first order approximation.

The ions may enter a first of the ion-optical cells in the analyser as a parallel beam at the ion entrance location, or diverge from a point at the ion entrance location (to a first order approximation).

It will be appreciated that the ion entrance location and/or ion exit location of any given ion-optical cell need not correspond to a physical aperture or other physical structure, but is/are location(s) defined by the focusing of the ion optical elements in that cell (i.e. the point-to parallel or parallel-to-point focusing).

Ions may be transmitted directly from one ion-optical cell to the next ion-optical cell. In other words, the ion exit location of any given ion-optical cell may correspond to the ion entrance location of the adjacent downstream ion-optical cell. The exit location of that downstream ion-optical cell may correspond to the ion entrance location of an ion-optical cell arranged adjacent and downstream thereof.

The analyzer may comprise only two of said ion-optical cells. Ions may be transmitted between and through these ion-optical cells only once, or a plurality of times. Alternatively, the analyzer may comprise more than two of said ion-optical cells. Ions may be transmitted between and through these ion-optical cells only once, or a plurality of times.

The ions may be subjected to one or more cycle as they travel through said ion-optical cells, wherein each cycle comprises either: (i) said parallel-to-point focusing by one of said cells and then said point-to-parallel focusing by another successive one of said cells; or (ii) said point-to-parallel focusing by one of said cells and then said parallel-to-point focusing by another successive one of said cells.

The ions may be subjected to an even, integer number of said cycles.

The ions may pass through each of said ion-optical cells in a spatially achromatic and/or energy isochronous mode to a first order approximation.

Each of said ion-optical cells may comprise at least three electrostatic sectors having at least two different deflection radii.

The mean ion path through a sector forms part of a circumference of a circle and the deflection radius of a sector is the radius defined by that circle.

In any given ion-optical cell, the flight time of ions entering the cell as a parallel beam may be independent, to the second order approximation, of the distance of the ions from a beam ion-optic axis on entering the cell (at least in the deflection (x-y) plane).

Any given ion-optical cell may provide second order focusing of ion flight time with respect to energy spread in ion bunches passing through the cell. More specifically, the ratios of sector deflection radii, sector deflection angles and sector focusing fields may be tuned to provide second order focusing of the flight time with respect to energy spread in ion bunches passing through the cell.

The electrostatic sectors may generate two-dimensional electrostatic fields that deflect the ions in the deflection plane, wherein the fields generated by the sectors are independent of any electric fields in the direction perpendicular to the deflection plane.

The electrostatic sectors may be cylindrical sectors.

The method may comprise accelerating ions into the flight region using an ion accelerator and/or detecting ions exiting the flight region using an ion detector.

The method may comprise directing or deflecting ions into the flight region with a drift electrode so as to cause the ions to drift through the analyzer in a drift (z−) dimension perpendicular to the deflection (x-y) plane as the ions travel through the ion-optical elements.

The method may comprise applying a voltage pulse to the drift electrode so as to pulse ions into said flight region. The drift electrode may form at least part of an ion accelerator that accelerates ions into the flight region.

The method may comprise guiding ions in a looped flight path in the deflection plane, optionally so as to perform a plurality of loops in the deflection plane.

The method may comprise providing one or more drift lens in the flight region so that the ions pass through the one or more drift lens as the ions loop around the deflection plane.

The method may comprise applying one or more voltages to the one or more drift lens so as to focus the ions in the drift (z−) dimension, so as to limit the divergence of the ions in said drift dimension as they drift along the drift dimension.

The method may comprise providing a plurality of said drift lenses spaced along said drift dimension.

The plurality of said drift lenses may be arranged in a periodic array in the drift dimension.

Each of the drift lenses may be an electrostatic lens and/or may be a 2D lens.

Each of the drift lenses may focus the ions in the drift dimension in a manner that is independent of ion focusing in the deflection plane or may be configured to generate electric fields that are quadrupolar in the plane orthogonal to the deflection plane.

The drift lenses may be coaxial in the deflection plane.

The drift lens(es) may be arranged between sectors or may be a locally z-focusing field within at least one of the sectors.

The drift electrode may cause the ions to drift in a linear (z−) drift direction. Alternatively, the analyzer may be arranged and configured such that the drift electrode pulses the ions to drift along a curved, e.g. circular, drift path.

The drift electrode may be arranged on a first side, in the drift (z−) dimension, of the ion-optical elements and the ion detector may be arranged on a second opposite side, in said drift dimension, of the ion-optical elements.

Alternatively, the drift electrode and ion detector may be arranged on a first side, in the drift dimension, of the ion-optical elements and one or more reflector electrode may be arranged on a second opposite side, in said drift dimension, of the ion-optical elements. The method may comprise applying one or more voltages to the drift electrode (e.g. ion accelerator) so as to cause ions to drift in the drift dimension towards the reflector electrode and then applying one or more voltage to the reflector electrode so as to reflect ions back in the drift dimension towards the detector. The ions may then be detected at the deflector.

One or more reflector electrode may be arranged on each side, in the drift dimension, of the ion-optical elements. Voltages may be applied to these reflector electrodes so as to reflect the ions along the drift dimension multiple times as the ions pass through the ion-optical elements. The ions may be detected at a detector, which may be arranged on either side of the ion-optical elements.

The reflector electrode(s) described herein enable ions to travel multiple times along the drift dimension, thus increasing the flight path of the ions in the analyzer and enabling higher resolving powers. The reflector electrode(s) may be supplied by a continuous or pulsed power supply.

The reflector electrode(s) described herein may not change the spatial focusing properties of the analyzer in the deflection (x-y) plane. However, the z-fields may affect the flight time of the ions and thus allow tuning the position of the time focus of the analyzer, i.e. may provide additional flexibility in tuning of the sector fields in the x-y deflection plane.

The method may comprise pulsing ions into the ion-optical elements of the flight region using a pulsed ion source or pulsed ion accelerator.

The pulsed ion source or ion accelerator may be one of: a MALDI ion source; a DE MALDI ion source; a SIMS ion source; a radiofrequency axial or linear ion trap; or an orthogonal ion accelerator for accelerating ions orthogonally. For example, MALDI, SIMS, or radio frequency linear ion traps (LITs) produce ion packets with relatively low energy spreads (e.g., from 10 to 100 eV) which are particularly suitable for sector-based folded flight path TOF mass spectrometers at high transport energies, e.g., above 10 keV.

The ion accelerator may pulse ions towards a detector in a series of ion accelerator pulses, wherein the timings of the pulses are determined by an encoding sequence that varies the duration of the time interval between adjacent pulses as the series of pulses progresses; and a processor may use the timings of the pulses in the encoding sequence to determine which ion data detected at the detector relate to which ion accelerator pulse so as to resolve spectral data obtained from the different ion accelerator pulses. The ion accelerator may pulse ions towards the detector at a rate such that some of the ions pulsed towards the detector in any given pulse arrive at the detector after some of the ions that are pulsed towards the detector in a subsequent pulse. The use of the encoding sequence (i.e. an encoded frequency pulsing method) enables ions to be injected into the flight region of the analyser at time intervals that are shorter than the ion separation time in the flight region and so enables the duty cycle of the analyser to be increased.

The method may be a method of time-of-flight mass spectrometry comprising pulsing ions into said flight region and detecting ions leaving the flight region with an ion detector. The flight region may be arranged between the ion accelerator and detector such that ions separate according to mass to charge ratio in the flight region. The pulse time of the ion accelerator and the detection time at the ion detector, for any given ion, may be used to determine the mass to charge ratio of the ion.

The present invention also provides a method of mass spectrometry comprising a method as described herein.

The mass analysers and methods described herein are not necessarily limited to time of flight and/or electrostatic trap mass analysers.

Accordingly, the present invention also provides a mass analyzer comprising:

an ion flight region comprising a plurality of ion-optical elements for guiding ions through the flight region in a deflection (x-y) plane;

wherein said ion-optical elements are arranged so as to define a plurality of identical ion-optical cells;

wherein the ion-optical elements in each ion-optical cell are arranged and configured so as to generate electric fields for either focusing ions travelling in parallel at an ion entrance location of the cell to a point at an ion exit location of the cell, or for focusing ions diverging from a point at the ion entrance location to travel parallel at the ion exit location;

wherein each ion-optical cell comprises a plurality of electrostatic sectors having different deflection radii for bending the flight path of the ions in the deflection (x-y) plane;

wherein the ion-optical elements in each cell are configured to generate electric fields that either (i) have mirror symmetry in the deflection plane about a line in the deflection plane that is perpendicular to a mean ion path through the cell at a point half way along the mean ion path through the cell, or (ii) have point symmetry in the deflection plane about a point in the deflection plane that is half way along the mean ion path through the cell; and wherein the ion-optical elements are arranged and configured such that, in the frame of reference of the ions, the ions are guided through the deflection plane in the ion-optical cells along mean flight paths that are of the same shape and length in each ion-optical cell.

The present invention also provides a corresponding method of mass analysis.

The spectrometer described herein may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The spectrometer may comprise one or more ion traps or one or more ion trapping regions.

The spectrometer may comprise one or more collision, fragmentation or reaction cells.

The spectrometer may comprise a device or ion gate for pulsing ions into the flight region and/or a device for converting a substantially continuous ion beam into a pulsed ion beam for pulsing ions into the flight region.

BRIEF DESCRIPTION OF THE DRAWINGS

Various embodiments will now be described, by way of example only, and with reference to the accompanying drawings in which.

DETAILED DESCRIPTION

As described above, folded flight path time of flight (TOF) mass spectrometers are known in which electrostatic sectors are used to bend the flight paths of the ions so that a relatively long TOF flight path can be provided in a relatively small instrument.

Various instrument geometries and ion flight paths of folded flight path TOF mass spectrometers will be described herein using Cartesian coordinates. The Cartesian coordinates are described herein such that the plane in which the electrostatic sectors bend the ion path are defined as the x-y plane, where x is the position along the ion optic axis (i.e. along the mean flight path of the ions), and y is perpendicular to this ion optic axis. The z-dimension is orthogonal to the x-y plane.

Figure 1:
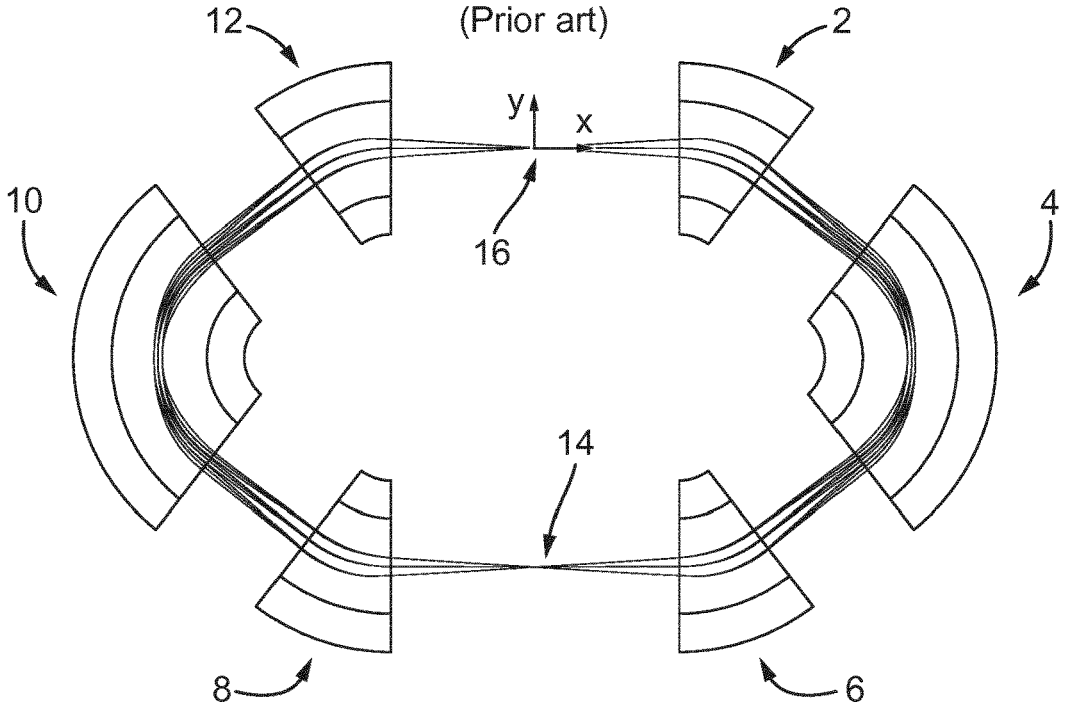
Fig. 1 (Prior art)
FIG. 1 shows an ion-optical scheme of a prior art sector based instrument in which the ions travel a substantially oval path.

FIG. 1 shows a schematic of the ion-optical scheme of part of a prior art folded flight path TOF mass spectrometer according to Sakurai et al (Nucl. Instrum. Meth. A427, 1999, 182-186). The spectrometer comprises ion-optical elements arranged so as to bend the ion path. The ion-optical elements comprise six electrostatic sectors 2-10 arranged so as to bend the ion path so that the ions are guided in a closed loop. A drift region is provided between each pair of adjacent sectors. Each sector is torroidal and the sectors have the same deflection radius. Electrostatic potentials are applied to the electrodes of each of the sectors so as to bend the flight paths of the ions so that the ions travel into the downstream electrostatic sector and continue around the closed path.

As can be seen from FIG. 1, ions pass into the first electrostatic sector 2 along the ion optical axis x. The ions diverge in the y-direction as they travel towards the first sector 2. The first sector 2 bends the ion path and directs the ions into the second sector 4. The second sector bends the ion path and directs the ions into the third sector 6. The ions emerge from the third sector 6 and are focused in the y-direction to a point 14 before diverging again in the y-direction and entering the fourth sector 8. The fourth sector 8 bends the ion path and directs the ions into the fifth sector 10. The fifth sector 10 bends the ion path and directs the ions into the sixth sector 12. The ions emerge from the sixth sector 12 and are focused in the y-direction to a point 16 before diverging again in the y-direction and re-entering the first sector 2. It can therefore be seen that the use of sectors 2-12 enables the TOF path length to be relatively long within a relatively small instrument.

However, as described in the Background section, conventional sector field folded flight path TOF mass spectrometers, such as that shown in FIG. 1, have limited spatial acceptance since they possess only first order TOF focusing with respect to the spatial spread of the ions in the plane that the sectors deflect the ions (i.e. the x-y plane). When such conventional instruments are described as having 'isochronous ion transport' this actually means, in practice, first order isochronous ion transport at small spatial acceptance, as described by Sakurai et al (Int. J. Mass Spectrom. Ion Proc., 63, 1985, 273-287). This is because, unlike ion mirror-based folded flight path TOF mass spectrometers, sector field based instruments have a curved ion optic axis and so multiple geometrical conditions are required to be satisfied to reach first order isochronicity. The number of second order aberrations is even larger, when accounting for mixed geometrical-chromatic TOF aberrations, and ion optical designers have conventionally been unable to compensate for these aberrations.

The analysis of aberrations can be assisted by considering the closed loop motion of the ions as periodic motion of the ions through a sequence of identical ion-optical cells, wherein each cell is considered to comprise a set of sector fields (and may optionally also comprise other ion optical elements such as ion lenses for focusing ions). For example, in FIG. 1 the three sectors 2-6 on the right side may be considered to form a first ion-optical cell and the three sectors 8-12 on the left side may be considered to form a second ion-optical cell. Each cell also has mirror symmetry about a line that is perpendicular to the mean ion path through the cell at the point half way along the mean ion path through the cell (in the x-y plane of deflection).

Ion trajectory projections in the x-y deflection plane can be described at each coordinate x along the ion optic axis by position vectors $\{y, b, \tau, \delta\}$, where: $b=dy/dx=\tan\beta$, $\beta$ being the inclination angle of ion trajectory projection to the ion optic axis; $\delta=(K-K_0)/K_0$, wherein $\delta$ is the relative deviation of the ion kinetic energy K component in the x-y deflection plane and the kinetic energy $K_0$ component in the deflection plane for ions moving along the ion optic axis; and $\tau=t-t_0$, where r is the difference between the flight time t of the considered ion and the flight time $t_0$ of an ion moving along the optic axis or 'mean trajectory'.

The transformation between the position vectors performed by one cell extending from the point $x=x_0$ and $x=x_1$ can be described by a transfer matrix $M^{(1)}$: $\{y_1, b_1, \tau_1, \delta_1\}=M^{(1)}\{y_0, b_0, \tau_0, \delta_0\}$, where the components with the subscript 1 correspond to position $x=x_1$ and the components with the subscript 0 correspond to position $x=x_0$. In this case, the transport of ions through N cells is described by a product of cell transfer matrices, i.e. as follows:

$$M^{(N)}=[M^{(1)}]^N \tag{1}$$

It is important to emphasize that equation 1 above requires that all cells have identical electric field distributions to each other, as viewed by the ions. This requires that the mean path of the ions be bent in the same manner by each cell, as viewed from the frame of reference of the ions. For example, in FIG. 1 the first cell formed of sectors 2-6 causes the mean path of the ions to be bent to the right as the ions travel through the first cell (from the ions' frame of reference), and the second cell formed by sectors 8-12 also causes the mean path of the ions to be bent in the same manner to the right as the ions travel through the second cell (from the ions' frame of reference).

The transformation of components of the position vector by one cell can be represented by aberration expansions, as follows:

$$\begin{aligned} y_1 &= Y_y y_0 + Y_b b a_0 + Y_b \delta_0 + Y_{yy} y_0^2 + Y_{yb} y_0 b_0 + Y_{bb} b_0^2 + \\ &\quad Y_{y\delta} y_0 \delta_0 + Y_{b\delta} b_0 \delta_0 + Y_{\delta\delta} \delta_0^2 + \ldots, \quad b = B_y y_0 + B_b b_0 + \\ &\quad B_\delta \delta_0 + B_{yy} y_0^2 + B_{yb} y_0 b_0 + B_{bb} b_0^2 + B_{y\delta} y_0 \delta_0 + B_{b\delta} b_0 \delta_0 + \\ &\quad B_{\delta\delta} \delta_0^2 + \ldots, \quad \tau_1 = T_y y_0 + T_b b_0 + T_\delta \delta_0 + T_{yy} y_0^2 + \\ &\quad T_{yb} y_0 b_0 + T_{bb} b_0^2 + T_{y\delta} y_0 \delta_0 + T_{b\delta} b_0 \delta_0 + T_{\delta\delta} \delta_0^2 + \ldots, \\ &\quad \delta_1 = \delta_0. \end{aligned}$$

The transformation up to a particular order of aberration expansion can be expressed by the transfer matrix of this order, which is expressed through the aberration coefficients up to the same order. The general form of the second order transfer matrix is presented in the book 'Optics of charged particles' by H. Wollnik (Acad. Press, Orlando, 1987).

It is relatively easy to select the combination of sector fields and the drift intervals between them so as to eliminate the first order dependence of time of flight on ion energy (i.e. $T_\delta=0$). In order to make a cell first order isochronous ($T_y=T_b=0$) it is also required to make the cell symmetric, either by mirror symmetry or point symmetry. The above-mentioned three conditions for first order focusing are satisfied in prior art sector based instruments. Note that due to the so-called symplectic conditions, a first order isochronous cell is always first order spatially achromatic: $Y_\delta=B_\delta=0$, and vice versa.

Referring back to the prior art instrument of FIG. 1, the arrangement shows sector fields and sample ion trajectories with different initial y-coordinates and different energies. The ions follow a closed oval path in the analyzer by passing through identical 180-degree deflecting cells. The geometric condition after each cell is $Y_b=0$, but the flight time focusing is performed only in the first order approximation and the aberration coefficients $T_{yy}$ and $T_{bb}$ remain.

Figure 2:
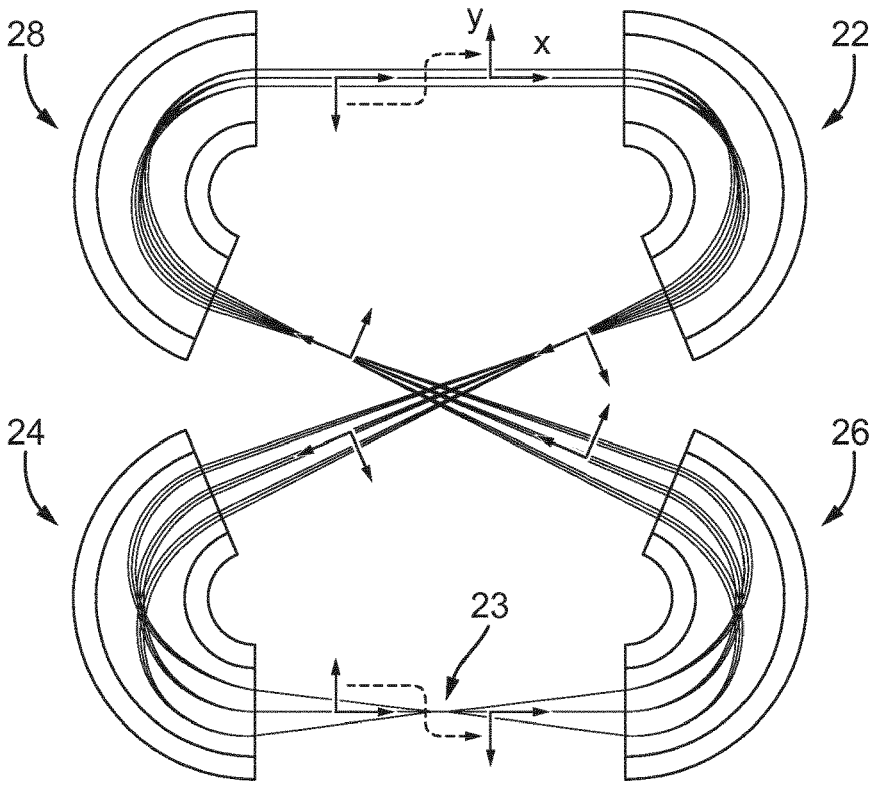
Fig. 2 (Prior art)
FIG. 2 shows an ion-optical scheme of another prior art sector based instrument in which the ions travel a figure-of-eight path.

FIG. 2 shows a schematic of the ion-optical scheme of a prior art folded flight path TOF mass spectrometer according to 'MULTUM II' by Toyoda et al (J. Mass Spectrom. 38, 2003, 1125-1142). The instrument comprises ion-optical elements arranged so as to guide ions in a figure-of-eight flight path. More specifically, the instrument comprises four electrostatic sectors 22-28 and drift regions between adjacent pairs of sectors, arranged so as to guide ions in a figure-of-eight flight path. Each sector has a 157-degree deflecting toroidal sector field. The arrangement of sector fields and sample ion trajectories for ions having different initial y-coordinates and different energies are shown. The motion of the ions will now be described in ions' frame of reference. As can be seen from FIG. 2, ions pass into the first electrostatic sector 22 along the ion optical axis x. The ions travel parallel, rather than diverging in the y-direction, as they travel towards the first sector 22. The first sector 22 bends the ion path to the right and directs the ions into the second sector 24. The second sector 24 bends the ion path to the left and directs the ions into the third sector 26. The ions emerge from the second sector 24 and are focused in the y-direction to a point 23 before diverging again in the y-direction and entering the third sector 26. The third sector 26 bends the ion path to the left and directs the ions into the fourth sector 28. The fourth sector 28 bends the ion path to the right. The ions emerge from the fourth sector 28 travelling parallel to each other, rather than diverging or converging in the y-direction, and then re-enter the first sector 22.

As will be described in more detail below, the inventors have recognized that it is necessary for each cell to perform parallel-to-point (or point-to-parallel) of the ion beam in order to avoid certain aberrations. Accordingly, the first sector 22 and second sector 24 may be considered to form a first ion-optical cell that provides parallel-to-point focusing of the ions in the x-y deflection plane, thus eliminating aberration coefficients $Y_y=B_b=0$. The third sector 26 and fourth sector 28 may be considered to form a second ion-optical cell that provides point-to-parallel divergence of the ion beam in the x-y deflection plane. However, as described above, equation 1 requires that all ion-optical cells have identical electric field distributions to each other, as viewed by the ions. In the analyzer of FIG. 2, the ions cannot be considered as passing through consecutive identical cells that meet the requirements of equation 1 above (and each having point-to-parallel or parallel-to-point focusing), because the orientation of the coordinate frame reverses after each cell. That is, in the frame of reference of the ions, the first cell consisting of sectors 22 and 24 causes the mean path of the ions to be bent firstly to the right and then to the left; whereas in contrast the second cell consisting of sectors 26 and 28 causes the mean path of the ions to be bent firstly to the left and then to the right. The ions are therefore guided in different manners by the first and second cells. Therefore, the cell symmetry condition described above in relation to equation 1 is violated and the second order flight time aberrations cannot be eliminated, even if ions are passed along the full figure-of-eight like path once or several times. Furthermore, in each zigzag cell (i.e. the combination of sectors 22 and 24, or the combination of sectors 26 and 28) the second order flight time aberrations $T_{yy}$ and $T_{bb}$ are not eliminated.

Figure 3:
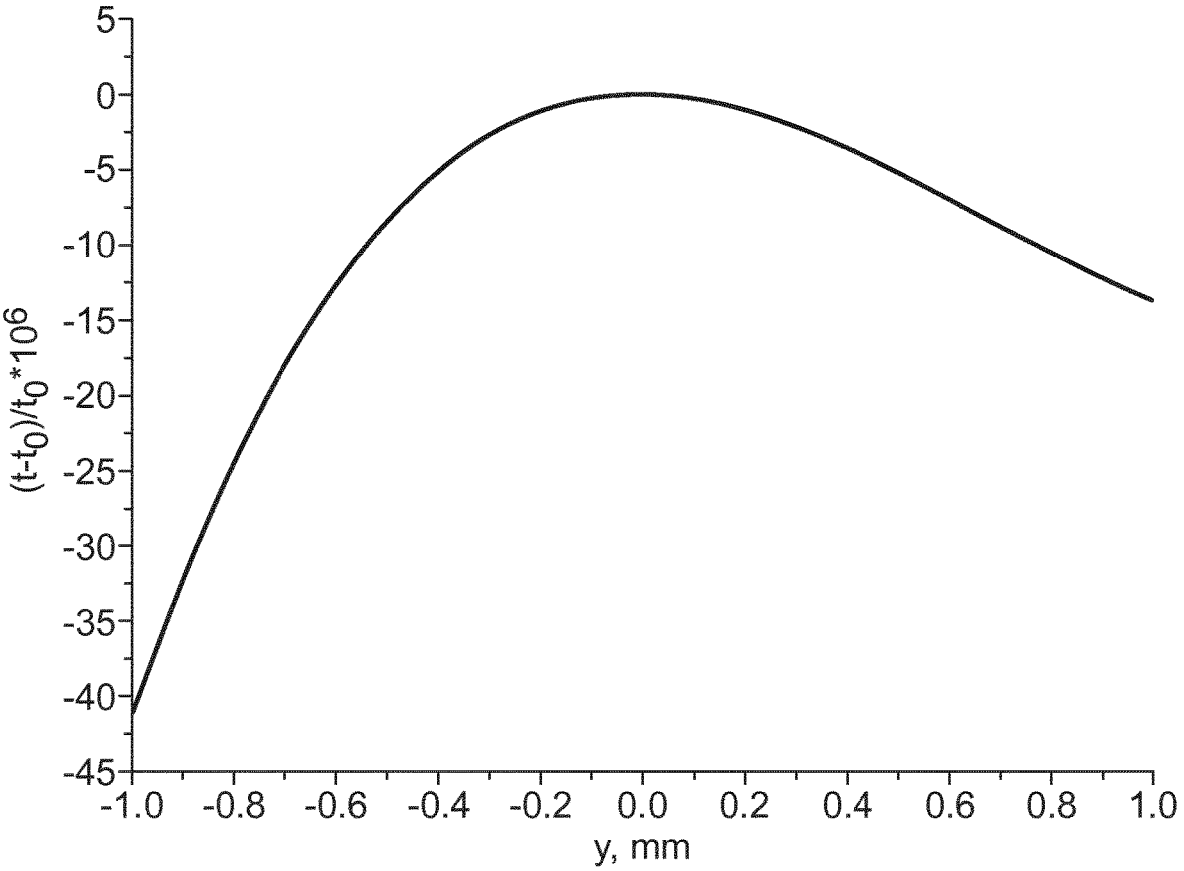
FIG. 3 shows a typical ion flight time dependence on the initial y-coordinate of the ions for the analyser of FIG. 2.

FIG. 3 is a graph showing a typical time dependence on the initial y-coordinate of the ion for the prior art analyzer of FIG. 2, as simulated by the computer program SIMION 8.0. The calculated value of the second order coefficient is $(T|yy)/t_0=-29.6\ m^{-2}$ which is in reasonable agreement with the data given by Toyoda et al (J. Mass Spectrom. 38, 2003, 1125-1142). This shows that the prior art arrangement of FIG. 2 does not suffers from higher order aberrations.

Therefore, it will be appreciated that the prior art instruments provide first order focusing only and that second order aberration coefficients are not able to be fully eliminated.

The inventors have recognized that using a special combination of symmetry and focusing conditions in sector field based folded flight path TOF mass spectrometers, and simultaneously using electrostatic sectors with different radii, allows the ion flight time to be independent of spatial coordinates as well as independent of mixed spatial-chromatic terms in the sector field deflection plane (i.e. the x-y plane) in the second order approximation, thus considerably increasing spatial acceptance of the instrument in this plane.

Various embodiments of the present invention will now be described, which allow full independence of ion flight time from spatial coordinates in the x-y deflection plane, i.e. to eliminate all second order coefficients for the flight time expansion except for $T_{\delta\delta}$.

As in the prior art instruments described above, it remains important for the analyzers according to the embodiments of the present invention to fulfill first order isochronicity. As described above in relation to equation 1, the sectors of the analyzers according to the embodiments of the present invention are arranged such that the motion of the ions in the x-y deflection plane can be considered to be a motion through a sequence of identical ion-optical cells.

Each cell is symmetric with respect to its middle, and the symmetry may be mirror symmetry such that the transfer matrix $M^{(1)}$ obeys the relationship:

$$M^{(1)}=P[M^{(1)}]^{-1}P \tag{2a}$$

where P is the reversing operator: $P\{y, b, \tau, \delta\}=\{y, -b, -\tau, \delta\}$.

Alternatively, the symmetry may be point symmetry such that the transfer matrix $M^{(1)}$ obeys the relationship:

$$M^{(1)}=RP[M^{(1)}]^{-1}PR \tag{2b}$$

where R is the rotating operator: $R\{y, b, \tau, \delta\}=\{-y, -b, \tau, \delta\}$.

The sectors are arranged and configured such that each cell is first order isochronous, as in prior art instruments, such that:

$$T_\delta=T_y=T_b=0 \tag{3}$$

The electrostatic fields in each cell are tuned such that, in the first order approximation, ions entering the cell as a parallel beam will be focused to a point at the exit (i.e. parallel-to-point focusing). As a result of the cell symmetry given by equations 2a or 2b above, this also means that the electrostatic fields in each cell are tuned such that, in the first order approximation, ions entering the cell that diverge from a point will be focused to a parallel beam at the exit (i.e. point-to-parallel focusing).

As each cell provides parallel-to-point focusing in the first order approximation (for ions entering the cell as a parallel beam), this leads to:

$$Y_y=0 \tag{4}$$

As each cell provides point-to-parallel focusing in the first order approximation (for ions diverging from a point and entering the cell), this leads to:

$$B_b=0 \tag{5}$$

The condition of equation 4 also leads to stable, indefinite ion confinement of ions in the x-y plane, since it satisfies the stability condition $-1<Y_y<1$. Note that some prior art sector systems such as that of FIG. 1 violate the stability condition since $Y_y=1$.

The inventors have recognized that in sector based instruments the compensation of at least one second order aberration (e.g. fulfilling the condition $T_{yy}=0$) can be reached by adding another degree of flexibility, such as by using a cell in which there are sector fields with two different deflection radii. As it is required for each cell to be symmetric, a cell having sectors of two different deflection radii must comprise at least three sectors.

Figure 4A:
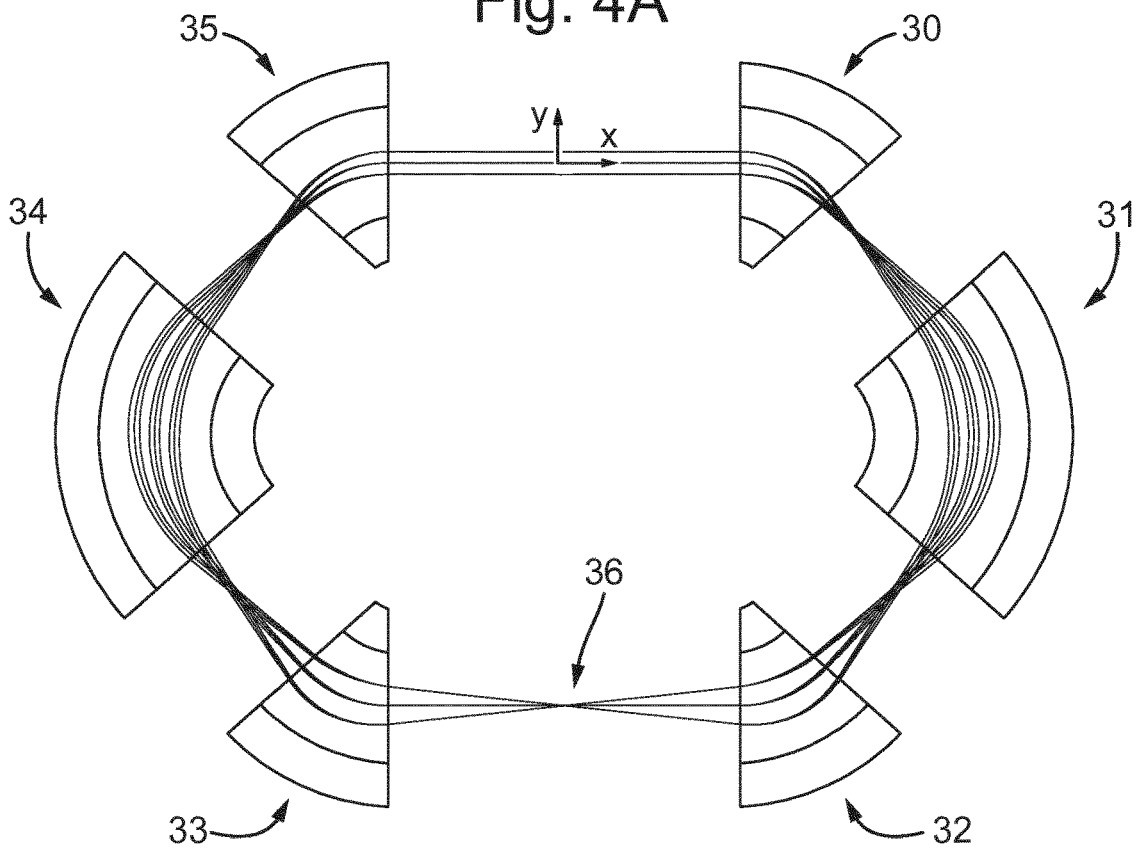
FIGS. 4A and 4B show ion-optical schemes of sector based instruments according to embodiments of the present invention having second order focusing of the flight time with respect to spatial ion spread in the deflection plane.
Figure 4B:
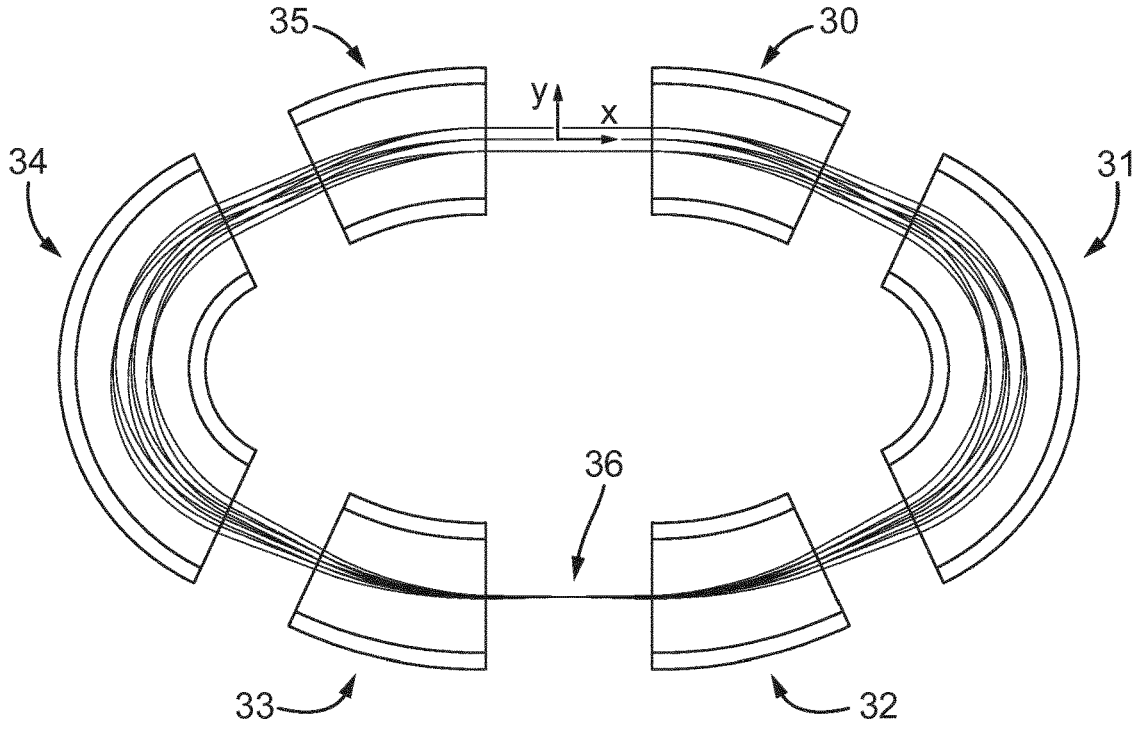

FIGS. 4A and 4B show ion-optical schemes of embodiments of the present invention with second order focusing of the flight time with respect to spatial ion spread in the x-y deflection plane. These instruments are capable of compensating for the second order time-of-flight aberration $T_{yy}$ such that:

$$T_{yy}=0 \tag{6}$$

The ion-optical elements in the analyzer of FIG. 4A comprise six electrostatic sectors 30-35 arranged so as to bend the ion path so that the ions are guided in a substantially oval closed loop. A drift region is provided between each pair of adjacent sectors. Electrostatic potentials are applied to the electrodes of each of the sectors so as to bend the flight paths of the ions so that the ions travel into the downstream electrostatic sector and continue around the closed path. The motion of the ions will now be described in the frame of reference of the ions. As can be seen from FIG. 4A, ions pass as a parallel ion beam into the first electrostatic sector 30 along the ion optical axis x. The first sector 30 bends the ion path to the right and directs the ions into the second sector 31. The second sector 31 bends the ion path to the right and directs the ions into the third sector 32. The ions emerge from the third sector 32 and are focused in the y-direction to a point 36 before diverging again in the y-direction and entering the fourth sector 33. The fourth sector 33 bends the ion path to the right and directs the ions into the fifth sector 34. The fifth sector 34 bends the ion path to the right and directs the ions into the sixth sector 35. The ions emerge from the sixth sector 35 as a parallel beam and re-enter the first sector 30. It can therefore be seen that the use of sectors 30-35 enables the TOF path length to be relatively long within a relatively small instrument.

The projection of the ion optic axis to the xy-plane forms a closed substantially oval path. Ion motion through the analyzer can be considered as the transport of ions through a sequence of identical cells, each cell deflecting the mean ion path by 180 degrees. More specifically, sectors 30-32 can be considered to form a first cell and sectors 33-35 can be considered to form a second cell. The sectors in each cell are arranged and configured to perform parallel-to-point focusing of the ions (or point-to-parallel focusing). Each cell also has mirror symmetry about a line that is perpendicular to the mean ion path through the cell at the point half way along the mean ion path through the cell (in the x-y plane of deflection).

In order to compensate for at least one second order aberration, each cell comprises sectors having different deflection radii. Considering the first cell, the radius of the optic axis in the second sector 31 is 1.55 times larger than the radius of the optic axis in each of the first and third sectors 30,32. The ion deflecting angle of each of the first and third sectors 30,32 is 49 degrees. The ion deflecting angle of the second sector 31 is 82 degrees. Similarly, in the second cell, the radius of the optic axis in the fifth sector 34 is 1.55 times larger than the radius of the optic axis in each of the fourth and sixth sectors 33,35. The ion deflecting angle of each of the fourth and sixth sectors 33,35 is 49 degrees. The ion deflecting angle of the fifth sector 34 is 82 degrees. The ion deflecting angles, deflection radii, and lengths of drift spaces between the sectors are chosen such that in each cell the ion-optical conditions of equations 3-5 above are satisfied, i.e. $Y_y=B_b=0$ and $T_y=T_b=T_6=0$. Additionally, the use of sectors having different deflection radii in each cell enables the system to compensate for the second order aberration of equation 6 above, i.e. $T_{yy}=0$.

FIG. 4B shows an embodiment that substantially corresponds to that of FIG. 4A, except that the sectors in FIG. 4B have different lengths, deflection radii and deflection angles. Like elements have been given the same reference numbers in FIGS. 4A and 4B. Considering the first cell in FIG. 4B, the radius of the optic axis in each of the first and third sectors 30,32 is 2.4 times larger than the radius of the optic axis the second sector 31. The ion deflecting angle of each of the first and third sectors 30,32 is 25 degrees. The ion deflecting angle of the second sector 31 is 130 degrees. Similarly, in the second cell, the radius of the optic axis in each of the fourth and sixth sectors 33,35 is 2.4 times larger than the radius of the optic axis in the fifth sector 34. The ion deflecting angle of each of the fourth and sixth sectors 33,35 is 25 degrees. The ion deflecting angle of the fifth sector 34 is 130 degrees. The ion deflecting angles, deflection radii, and lengths of drift spaces between the sectors are chosen such that in each cell the ion-optical conditions of equations 3-5 above are satisfied, i.e. $Y_y=B_b=0$ and $T_y=T_b=T_6=0$. Additionally, the use of sectors having different deflection radii in each cell enables the system to compensate for the second order aberration of equation 6 above, i.e. $T_{yy}=0$.

Although two specific examples have been described in relation to FIGS. 4A and 4B, it will be appreciated that embodiments of the present invention may have other values of deflection radii ratio and/or deflection angles.

The inventors have realized that the parallel-to-point (and point-to-parallel) geometric focusing described above in relation to equations 4 and 5 within a symmetric cell according to equations 2a or 2b has the important consequence that two second order aberration coefficients for the flight time expansion are proportional to each other, i.e. that:

$$T_{yy}=B_y^2T_{bb} \tag{7}$$

Thus, the compensation of one second order aberration $T_{yy}=0$ as described in relation to equation 6 automatically compensates for another proportional second order aberration such that:

$$T_{bb}=0 \tag{8}$$

Accordingly, it has been recognized that each identical cell of the system is now able to be first order isochronous in accordance with equation 3, provide parallel-to-point focusing (or point-to-parallel focusing) according to equations 4 and 5, and is able to compensate for two second order aberrations according to equations 6 and 8.

The inventors have also recognized that fulfilling the above three conditions automatically allows the elimination of the rest of the second order time of flight aberrations (except for $T_{\delta\delta}$) after passing the ions through a number of the cells. This can be shown by calculating geometric and time of flight coefficients of aberration expansions after several cells by using multiplication of the cell transfer matrices. Indeed, considering equations 4 and 5 for a single cell, the multiplication of transfer matrices as in equation 1 above gives the following first order geometric transfer matrix coefficients after two cells:

$$Y_y^{(2)}=B_b^{(2)}=-1, B_y^{(2)}=Y_b^{(2)}=0 \quad (9)$$

The same multiplication for the time of flight coefficients shows that all of the elimination conditions of equations 3, 6 and 8 above, which are achieved for a single cell, also remain valid after two cells, i.e.:

$$T_\delta^{(2)}=T_y^{(2)}=T_b^{(2)}=T_{yy}^{(2)}=T_{bb}^{(2)}=0 \quad (10)$$

Also, due to the conditions of equations 4 and 5 above, the mixed geometric aberration coefficient $T_{yb}$ is eliminated after the ions pass through two identical cells. i.e.:

$$T_{yb}^{(2)}=0$$

By multiplying two identical second order transfer matrices for two cells, it is also apparent that all time of flight coefficients that are eliminated after the ions pas through two cells (see equations 10 and 11) remain eliminated after the ions pass through four cells, i.e.:

$$T_\delta^{(4)}=T_y^{(4)}=T_b^{(4)}=T_{yy}^{(4)}=T_{bb}^{(4)}=T_{yb}^{(4)}=0 \quad (12)$$

Also, due to the conditions in equation 9, the mixed geometric-chromatic aberration coefficients are also eliminated after the ions pass through each 4 cells, i.e.:

$$T_{y\delta}^{(4)}=T_{b\delta}^{(4)}=0. \quad (13)$$

Thus, it is clear from equations 12 and 13 that after ions pass through four successive cells all second order aberration coefficients for the flight time expansion, except for $T_{\delta\delta}$, are eliminated.

In order to illustrate the ability of an embodiment of the present invention to compensate for aberrations, Table 1 below is presented. Table 1 shows the aberration coefficients after the ions pass through one, two and four cells in the instrument of FIG. 4A. The passage of ions through two sectors is one loop around the instrument shown in FIG. 4A. The unit for the coordinate y is metres and the flight path length per loop is 1.95 m.

TABLE 1

| Coefficient | 1 cell (half loop) | 2 cells (one loop) | 4 cells (two loops) |
|---|---|---|---|
| $Y_y$ | 0 | −1 | 1 |
| $Y_b$ | 0.091 | 0 | 0 |
| $B_y$ | −11.0 | −1 | 1 |
| $B_b$ | 0 | 0 | 0 |
| $T_y/t_0$ | 0 | 0 | 0 |
| $T_b/t_0$ | 0 | 0 | 0 |
| $T_\delta/t_0$ | 0 | 0 | 0 |
| $T_{yy}/t_0$ | 0 | 0 | 0 |
| $T_{yb}/t_0$ | −4.60 | 0 | 0 |
| $T_{bb}/t_0$ | 0 | 0 | 0 |
| $T_{y\delta}/t_0$ | 4.82 | 0.025 | 0 |
| $T_{b\delta}/t_0$ | 0.434 | 0.436 | 0 |
| $T_{\delta\delta}/t_0$ | 0.084 | 0.084 | 0.084 |

It can be seen from Table 1 that the only non-vanishing second order aberration after the ions pass through four successive cells is $T_{\delta\delta}/t_0$, and even then the value of this aberration is about 3 times smaller than in the prior art analyzer of FIG. 2.

The system of FIG. 4B is also first order isochronous and second order spatially isochronous, meaning that all of the aberration coefficients listed in Table 1 are zero, except $T_{\delta\delta}/t_0$, which is 0.276.

Figure 5A:
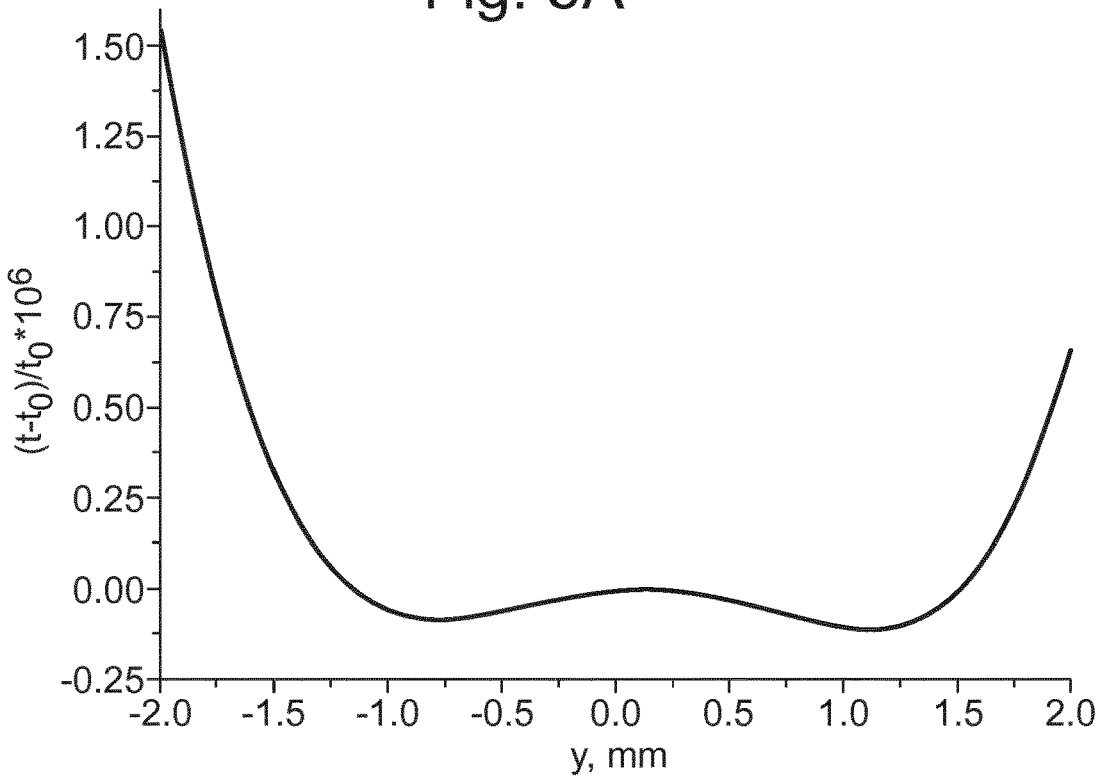
FIGS. 5A and 5B show simulated dependencies of the flight time on the initial y-coordinate of the ions and the angle b, respectively, for the analyser of FIG. 4A.

FIG. 5A is a graph showing the simulated flight time dependence on the initial y-coordinate of the ion for the analyzer of FIG. 4A. The relative time deviation $\tau/t_0$ is within $10^{-6}$ in the intervals $\Delta y$=3.5 mm. The dependence t(y) is dominated by a $4^{th}$ order term. It can be seen by comparing FIG. 5A to FIG. 3 that the flight time dependence on the initial y-coordinate is improved for the analyzer of FIG. 4A over the analyzer of FIG. 2.

Figure 5B:
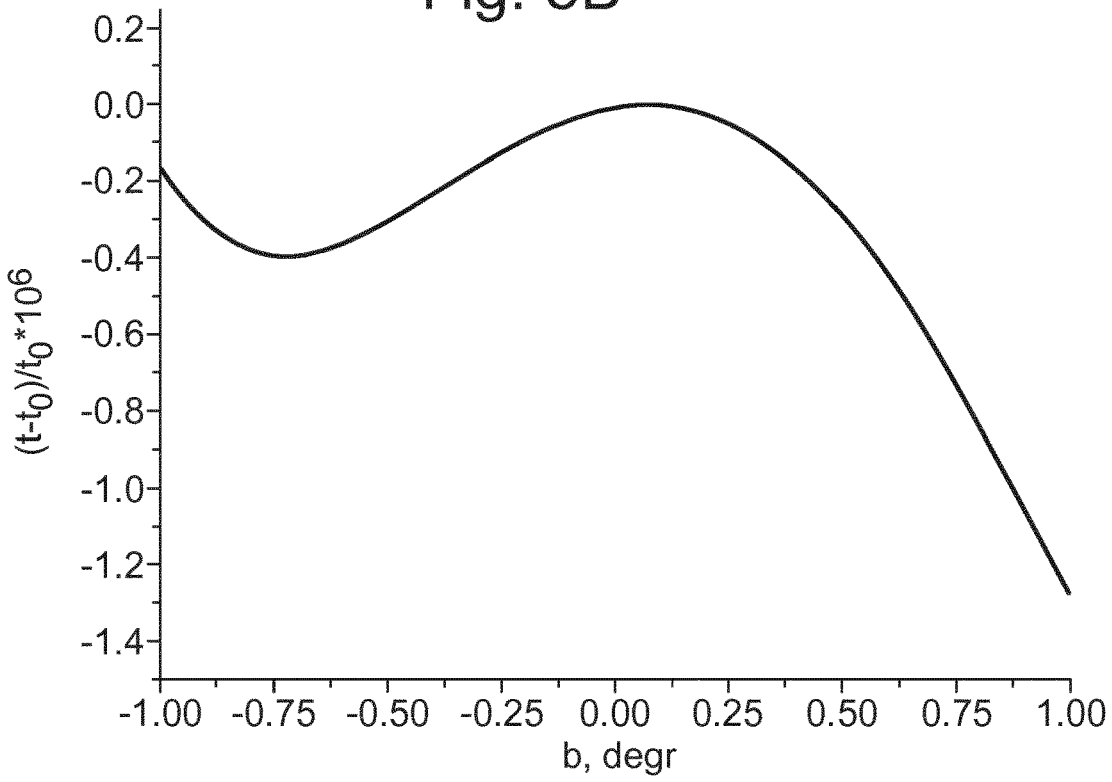

FIG. 5B is a graph showing the simulated flight time dependence on the angle β=arctan (b) for the analyzer of FIG. 4A. The relative time deviation $\tau/t_0$ is within $\Delta\beta\approx 2$ degrees. The dependence t(b) is dominated by a $3^{rd}$ order term.

In the embodiments described above, the ions may be pulsed into the analyzer and guided along a flight path defined by the sectors. The sectors bend the flight path and hence allow a relatively long flight path to be provided in a relatively small space. When the ions have travelled a desired flight path length, e.g. when the ions have travelled through a desired number of cells of the analyzer, the ions are directed onto a detector. The duration of time between an ion being pulsed into the analyzer and the ion being detected at the detector can be used to determine the mass to charge ratio of that ion, as in conventional TOF mass analyzers. As the instruments of the present invention have a relatively long flight path length, the mass resolution of the instrument may be relatively high. The configuration of the sectors increases the flight path length per unit size of the instrument, whilst eliminating second order aberrations that would otherwise deteriorate mass analysis.

The motion of the ions around the analyzer has only been described in the x-y deflection plane. When the ions have travelled the desired flight path length they may be deflected, e.g. in a direction perpendicular to the mean flight path, onto the detector. Alternatively, the ions may be caused to drift in a direction perpendicular to the x-y plane (i.e. the z-direction) as they pass around the analyzer in the x-y plane. The ion detector may be arranged at a position in the z-direction such that after a predetermined flight path (e.g., after a predetermined number of loops in the x-y place) the ions have travelled a distance in the z-direction such that the ions impact on the ion detector.

Figure 6B:
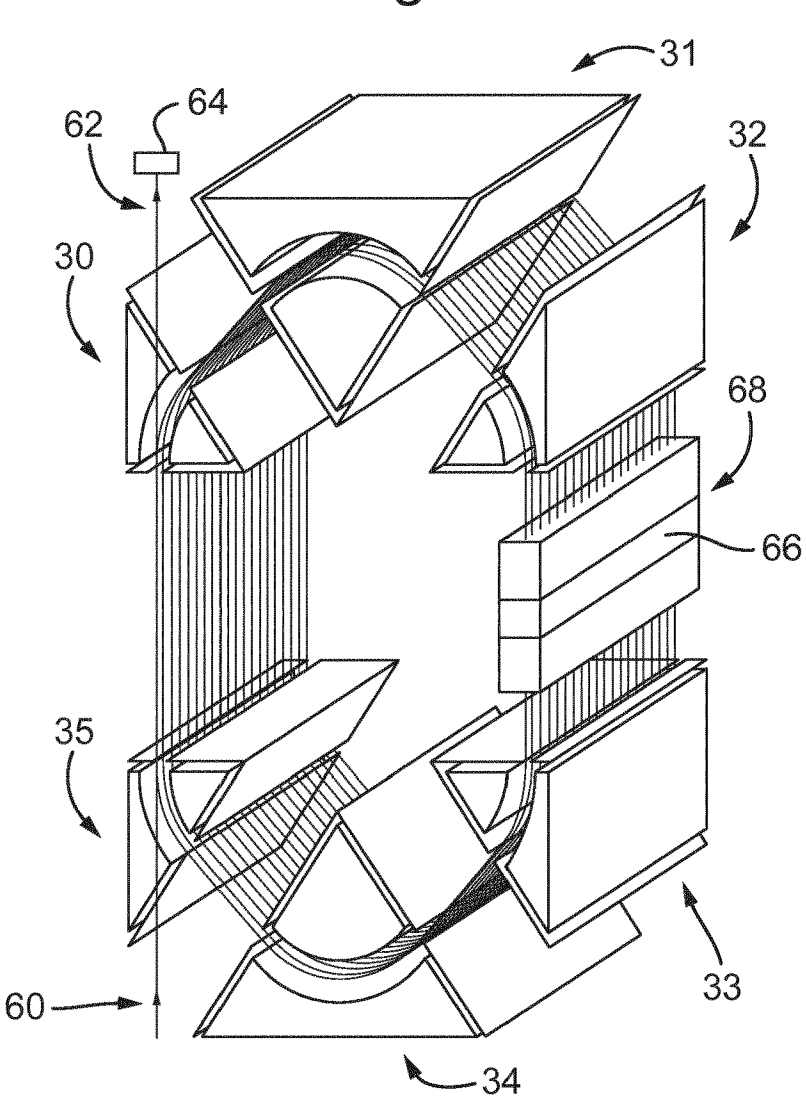
FIG. 6B shows an embodiment having an end deflector for reversing the direction of the ions in the z-direction.
Figure 6A:
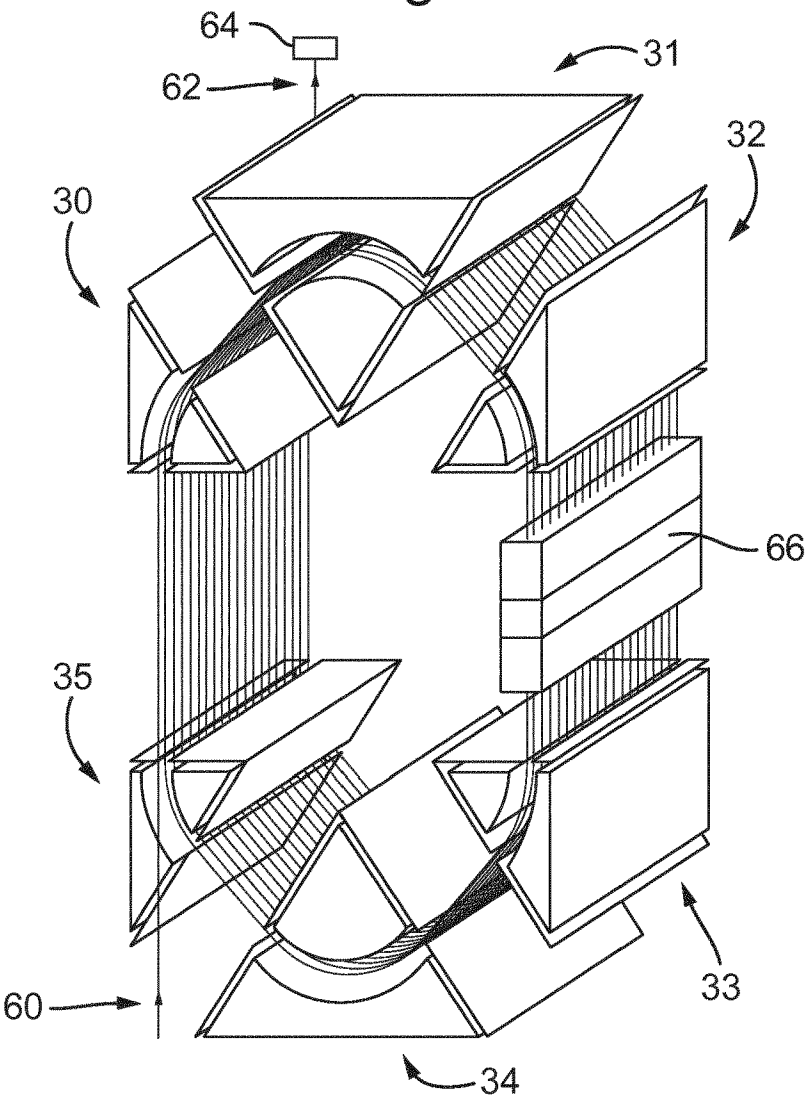
FIG. 6A shows an ion-optical scheme of a sector based instruments according to an embodiment of the present invention having cylindrical sectors and periodic lenses for confining ions in the z-direction.

FIG. 6A shows a perspective view of a schematic in which ions travel in the x-y plane and also travel in the z-direction. The analyser is of substantially the same form as that described in relation to FIGS. 4A-4B and like elements have been given like reference numbers. However, FIG. 6A also illustrates that the ions may drift in the z-direction as they loop around the analyser through the cylindrical sectors. Ions are pulsed into the first sector 30 along axis 60. Ions may be pulsed into the sector 30 at an angle such that they drift in the z-direction, or a drift electrode may be provided that urges the ions in the z-direction. The first sector 30, second sector 31 and third sector 32 form a first cell that bends the flight path of the ions, in the same manner described in relation to FIGS. 4A-4B. The fourth sector 33, fifth sector 34 and sixth sector 35 form a second cell that bends the flight path of the ions, in the same manner described in relation to FIGS. 4A-4B. The ions then re-enter the first sector 30 and continue around the analyser in the x-y plane for another loop. This looping in the x-y plane is repeated as the ions drift along the z-direction until the ions exit the fifth sector 35 along exit axis 62 and impact on ion detector 64.

The analyser may also comprise periodic drift lenses 66 for confining ions in the z-direction. The drift lenses 66 focus ions in the z-direction and thus maintain the ion packets at a desired x-position as they loop around the analyzer in the x-y plane. The electric fields of the periodic lenses 64 may not focus or disperse the ions in the x-y plane but, e.g. by inducing an accelerating or retarding field, allow tuning a position of the final time focus at the detector 64. Note that in contrast to periodic lenses used in ion mirror based multi-reflecting time of flight mass spectrometers, in sector field instruments ions can pass through periodic lenses only once per loop. Although z-direction periodic lenses 66 are only shown between sectors 32 and 33 it is contemplates that these lenses, or additional such lenses, may be arranged between any other pair of sectors such as between sectors 30 and 35. Periodic lenses may be arranged between more than one pair of sectors so as to provide for tighter ion confinement in the z-direction. The periodic lenses may produce a two-dimensional focusing field, may be coaxial lenses, or may have an adjustable quadrupolar field component for adjustments of ion trajectories in the x-y plane.

FIG. 6B shows an embodiment that is substantially the same as that shown in FIG. 6A, except that it additionally has a reflecting electrode 68 for reflecting the ions back in the z-direction. The ions are pulsed into the analyser along path 60, travel around the x-y plane and along the z-direction in the same manner as described in relation to FIG. 6A. However, rather than striking ion detector 64 at the z-end of the device, the ions are reflected back in the z-direction by reflecting electrode 68. As the ions drift back along the device in the x-direction they continue to loop around the x-y plane until they exit the analyser along path 62 and impact on ion detector 64. It will be appreciated that this embodiment doubles the ion flight path length as compared to the embodiment of 6A, without increasing the physical dimensions of the instrument or restricting mass range.

Figure 7:
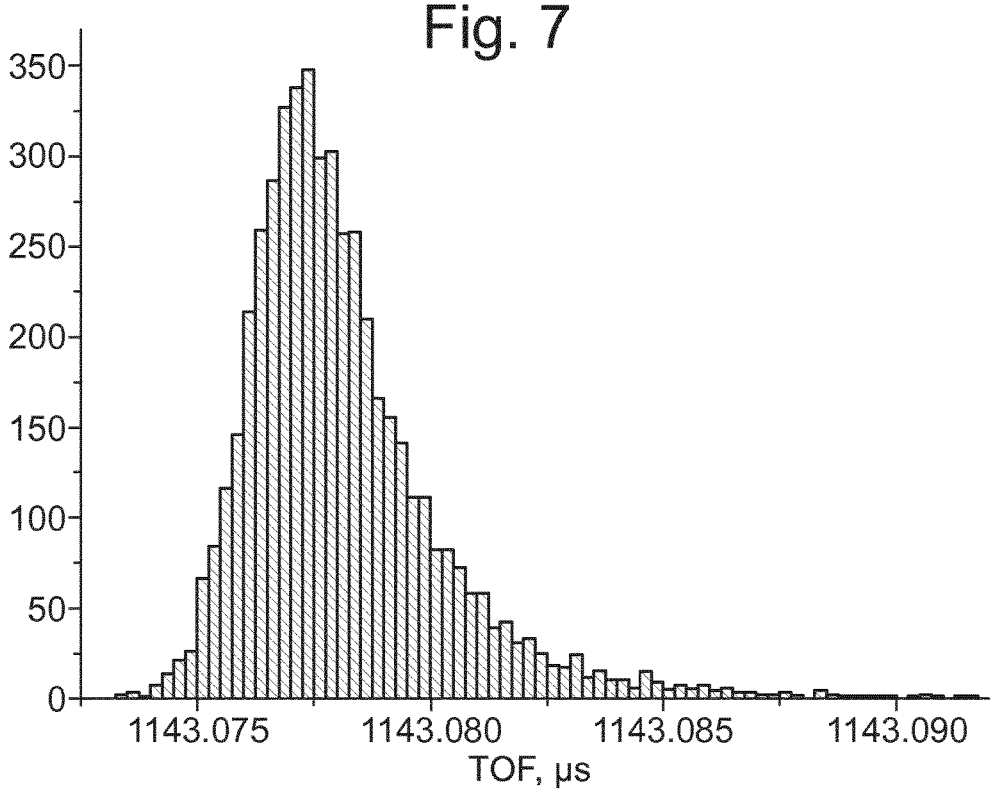
FIG. 7 shows a simulated time peak for an analyser according to FIG. 4A.

FIG. 7 shows a simulated time peak after 20 loops of ions in an analyser of FIG. 4A having a 1.95 m long path per loop, i.e. a full path length of 39 m. The ion packet was simulated as a Gaussian profile having a 2 ns initial time FWHM width, $\Delta y=2$ mm, $\Delta b=1$ deg, a 35 mm×mrad phase space in the X-Y deflection plane, a m/z=1000 amu, a mean kinetic energy of K=6 keV, and an energy spread $\Delta K=30$ eV. After passing 20 loops the packet time width increases from 2 ns to 2.75 ns, i.e. a mass resolving power R=200 000 is achieved. Comparative simulation shows that achieving the same resolving power in prior art sector-based spiral flight path instruments would require reducing the phase space in the x-y plane by an order of magnitude. Thus, embodiments of the present invention are able to provide at least an order of magnitude improved product of phase space acceptance and resolving power. Also, an order of magnitude higher spatial acceptance means at least an order of magnitude higher space charge tolerance of the analyzer, since ion packets are known to expand spatially under own space charge.

At a simulated resolving power of R=200,000, embodiments of the present invention have an acceptance over 30 mm x mrad, while prior art sector based instruments have an acceptance of less than 3 mm x mrad. The embodiments of the present invention therefore accommodate ion sources having relatively great emittances, such as SIMS and DE MALDI sources, which tend to have emittances between 3 and 10 mm x mrad. The embodiments are also able to accommodate radio-frequency linear ion traps well, which tend to have larger emittances, e.g., emittances of at least 10 mm x mrad. The embodiments also have a relatively high tolerance to space charge effects (the analyzer tolerates ion packets spatial expansion), and an ability to reach higher resolving powers for ion sources with limited emittance. Compact analyzers or ion guides may also be used to match an ion sources emittance with the analyzer acceptance.

Figure 8:
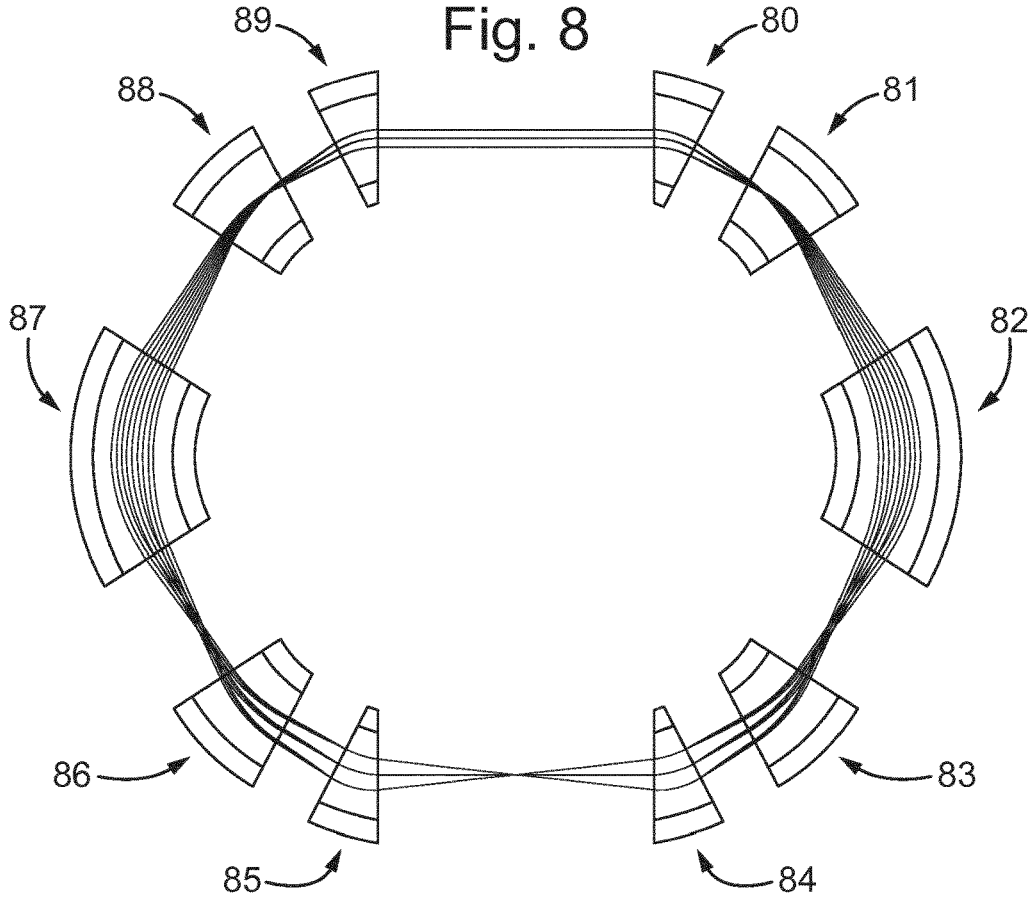
FIG. 8 shows an ion-optical scheme of an embodiment of the present invention having five sectors per cell.

FIG. 8 shows an ion-optical scheme according to an embodiment of the present invention with second order focusing of the flight time with respect to both energy and spatial ion spread in the x-y deflection plane. The analyser is substantially the same as that shown and described in relation to FIG. 4A, except that the ion-optical elements in the first cell comprise five cylindrical sectors 80-84 rather than three sectors, and the ion-optical elements in the second cell comprise five cylindrical sectors 85-89 rather than three sectors. The deflection angle of each of sectors 82 and 87 is 64 degrees, and the deflection angle of each of the other sectors is 29 degrees. The deflection radius of each of sectors 82,87 is 1.9 times larger than the deflection radius of each of sectors 80,84,85,89. The deflection radius of each of sectors 81,83,86,88 is 2.1 times larger than of each of sectors 80,84,85,89.

Figure 9:
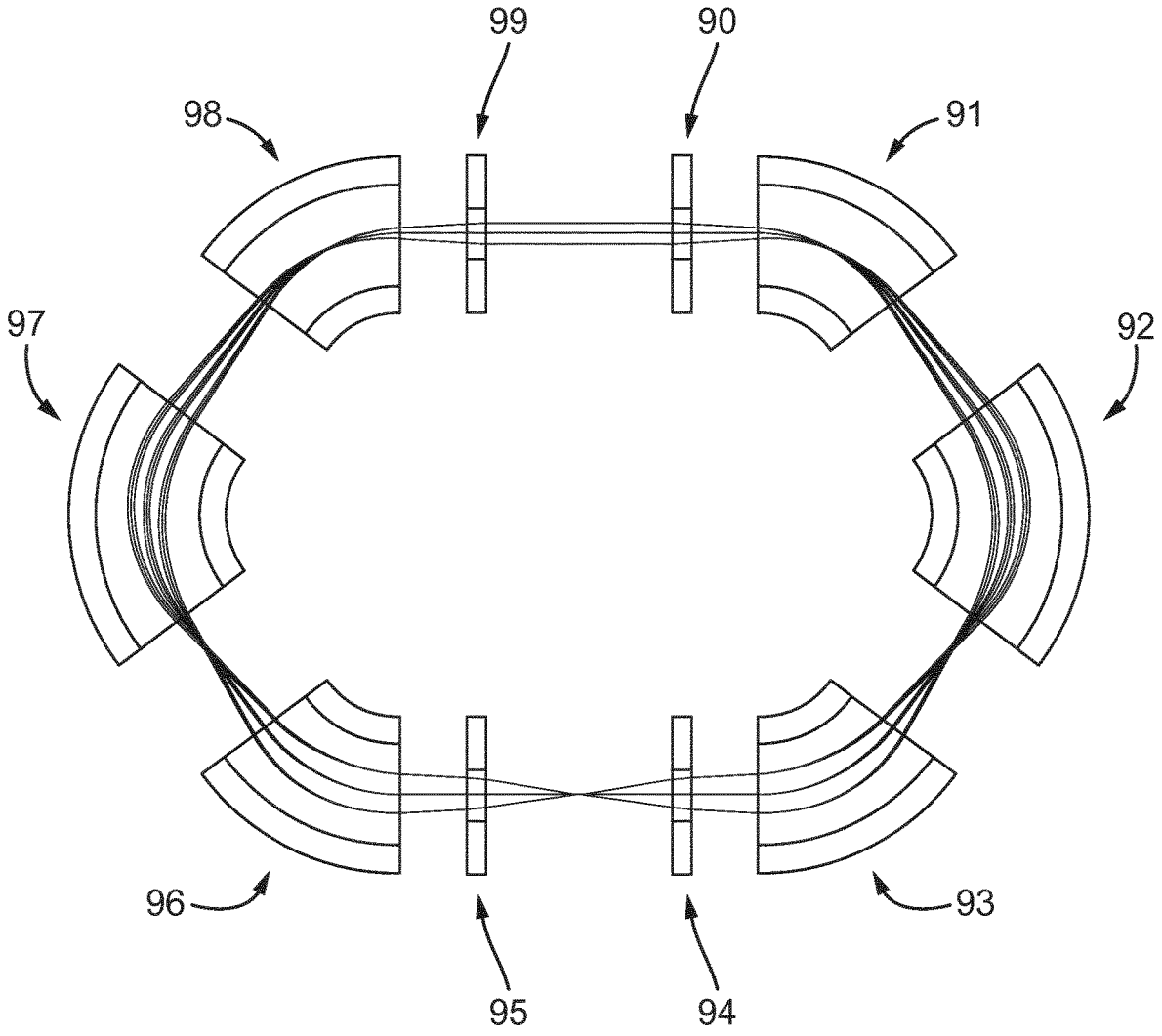
FIG. 9 shows an ion-optical scheme of an embodiment of the present invention having three sectors and two lenses in each cell.

FIG. 9 shows another ion-optical schemes according to an embodiment of the present invention with second order focusing of the flight time with respect to both energy and spatial ion spread in the x-y deflection plane. The analyser is substantially the same as that shown and described in relation to FIG. 4A, except that the ion-optical elements comprise sectors and 2D lenses. In each cell the three sectors are arranged between a pair of 2D lenses for focussing the ions in the x-y plane. More specifically, in the first cell the three sectors 91-93 are arranged between 2D lenses 90 and 94, and in the second cell the three sectors 96-98 are arranged between 2D lenses 95 and 99. In this embodiment, the angle of deflection of each of the sectors 91, 93, 96 and 98 is 50 degrees, and the angle of deflection of each of sectors 92,97 is 80 degrees. The deflection radius of each of sectors 92,97 is 1.2 times larger than the deflection radius of each of sectors 91, 93, 96 and 98.

Although the present invention has been described with reference to preferred embodiments, it will be understood by those skilled in the art that various changes in form and detail may be made without departing from the scope of the invention as set forth in the accompanying claims.

The invention claimed is:

1. A time-of-flight or electrostatic trap mass analyzer comprising:

an ion flight region comprising a plurality of ion-optical elements for guiding ions through the flight region in a deflection (x-y) plane;

wherein said ion-optical elements are arranged so as to define a plurality of identical ion-optical cells;

wherein the ion-optical elements in each ion-optical cell are arranged and configured so as to generate electric fields for either focusing ions travelling in parallel at an ion entrance location of the cell to a point at an ion exit location of the cell, or for focusing ions diverging from a point at the ion entrance location to travel parallel at the ion exit location;

wherein each ion-optical cell comprises a plurality of electrostatic sectors having different deflection radii for bending the flight path of the ions in the deflection (x-y) plane;

wherein the ion-optical elements in each cell are configured to generate electric fields that either (i) have mirror symmetry in the deflection plane about a line in the deflection plane that is perpendicular to a mean ion path through the cell at a point half way along the mean ion path through the cell, or (ii) have point symmetry in the deflection plane about a point in the deflection plane that is half way along the mean ion path through the cell; and wherein the ion-optical elements are arranged and configured such that, in the frame of reference of the ions, the ions are guided through the deflection plane in the ion-optical cells along mean flight paths that are of the same shape and length in each ion-optical cell.

2. The analyser of claim 1, wherein the parallel-to-point focusing, or point-to-parallel focusing, is focusing to the first order approximation.

3. The analyser of claim 1, wherein said ion-optical elements are arranged and configured such that said ions travel through said ion-optical cells such that they are subjected to one or more cycle, wherein each cycle comprises either: (i) said parallel-to-point focusing by one of said cells and then said point-to-parallel focusing by another successive one of said cells; or (ii) said point-to-parallel focusing by one of said cells and then said parallel-to-point focusing by another successive one of said cells.

4. The analyzer of claim 3, wherein said ion-optical elements are arranged and configured such that said ions are subjected to an even, integer number of said cycles.

5. The analyzer of claim 1, wherein said ion-optical elements are arranged and configured such that, in use, said ions pass through each of said ion-optical cells in a spatially achromatic and/or energy isochronous mode to a first order approximation.

6. The analyzer of claim 1, wherein each of said ion-optical cells comprises at least three electrostatic sectors having at least two different deflection radii.

7. The analyzer of claim 1, wherein the ion-optical elements are arranged and configured in any given ion-optical cell such that for ions entering the cell as a parallel beam, the flight time of these ions through the cell is independent, to the second order approximation, of the distance of the ions from a beam ion-optic axis on entering the cell, at least in the deflection (x-y) plane.

8. The analyzer of claim 1, wherein the ion-optical elements are arranged and configured in any given ion-optical cell so as to provide second order focusing of ion flight time with respect to energy spread in ion bunches passing through the cell.

9. The analyzer of claim 1, comprising an ion accelerator for accelerating ions into the flight region and/or an ion detector for detecting ions exiting the flight region.

10. The analyzer of claim 1, comprising a drift electrode arranged and configured to cause ions to drift through the analyzer in a drift (z–) dimension perpendicular to the deflection (x-y) plane as the ions travel through the ion-optical elements.

11. The analyzer of claim 10, wherein the ion-optical elements are arranged and configured to cause the ions to have a looped flight path in the deflection plane and to perform a plurality of loops in the deflection plane; and wherein the analyzer comprises one or more drift lens arranged in the flight region so that the ions pass through the one or more drift lens as the ions loop around the deflection plane, and wherein the one or more drift lens is configured to focus the ions in the drift (z–) dimension so as to limit the divergence of the ions in said drift dimension as they drift along the drift dimension.

12. The analyzer of claim 11, wherein the analyzer comprises a plurality of said drift lenses spaced along said drift dimension.

13. The analyzer of claim 10, wherein said drift electrode is arranged on a first side, in the drift (z–) dimension, of the ion-optical elements and the ion detector is arranged on a second opposite side, in said drift dimension, of the ion-optical elements.

14. The analyzer of claim 10, wherein said drift electrode and ion detector are arranged on a first side, in the drift dimension, of the ion-optical elements and one or more reflector electrode is arranged on a second opposite side, in said drift dimension, of the ion-optical elements; wherein said reflector electrode is configured to reflect ions back in the drift dimension towards the detector.

15. The analyzer of claim 13, wherein one or more reflector electrode is arranged on each side, in the drift dimension, of the ion-optical elements and are configured to reflect the ions along the drift dimension as the ions pass through the ion-optical elements.

16. The analyzer of claim 1, wherein each of the electrostatic sectors is a cylindrical sector having its axis of cylindrical rotation aligned in the dimension orthogonal to the deflection (x-y) plane.

17. The analyzer of claim 1, wherein said analyzer is one of:

(i) a time-of-flight mass analyzer comprising an ion accelerator for pulsing ions into said flight region and an ion detector, wherein said flight region is arranged between said ion accelerator and detector such that ions separate according to mass to charge ratio in the flight region;

(ii) an open trap mass analyzer configured such that ions enter a first end of the flight region and exit the flight region at a second, opposite end;

(iii) an electrostatic trap mass analyzer having an image current detector for detecting ions; or (iv) an electrostatic trap mass analyzer having an ion detector arranged for detecting only a portion of the ions passing the detector.

18. A mass spectrometer comprising an analyzer as claimed in claim 1.

19. A method of time of flight or electrostatic trap mass analysis comprising:

transmitting ions through a flight region comprising a plurality of ion-optical elements that guide the ions in a deflection (x-y) plane;

wherein said ion-optical elements are arranged so as to define a plurality of identical ion-optical cells;

wherein the ion-optical elements in each ion-optical cell generate electric fields that either focus ions travelling in parallel at an ion entrance location of the cell to a point at an ion exit location of the cell, or focus ions diverging from a point at the ion entrance location to travel parallel at the ion exit location;

wherein each ion-optical cell comprises a plurality of electrostatic sectors having different deflection radii that bend the flight path of the ions in the deflection (x-y) plane;

wherein the ion-optical elements in each cell generate electric fields that either (i) have mirror symmetry in the deflection plane about a line in the deflection plane that is perpendicular to a mean ion path through the cell at a point half way along the mean ion path through the cell, or (ii) have point symmetry in the deflection plane about a point in the deflection plane that is half way along the mean ion path through the cell; and wherein the ion-optical elements guide the ions through the deflection plane in the ion-optical cells along mean flight paths that, in the frame of reference of the ions, are of the same shape and length in each ion-optical cell.

20. A mass analyzer comprising:

an ion flight region comprising a plurality of ion-optical elements for guiding ions through the flight region in a deflection (x-y) plane;

wherein said ion-optical elements are arranged so as to define a plurality of identical ion-optical cells;

wherein the ion-optical elements in each ion-optical cell are arranged and configured so as to generate electric fields for either focusing ions travelling in parallel at an ion entrance location of the cell to a point at an ion exit location of the cell, or for focusing ions diverging from a point at the ion entrance location to travel parallel at the ion exit location;

wherein each ion-optical cell comprises a plurality of electrostatic sectors having different deflection radii for bending the flight path of the ions in the deflection (x-y) plane;

wherein the ion-optical elements in each cell are configured to generate electric fields that either (i) have mirror symmetry in the deflection plane about a line in the deflection plane that is perpendicular to a mean ion path through the cell at a point half way along the mean ion path through the cell, or (ii) have point symmetry in the deflection plane about a point in the deflection plane that is half way along the mean ion path through the cell; and wherein the ion-optical elements are arranged and configured such that, in the frame of reference of the ions, the ions are guided through the deflection plane in the ion-optical cells along mean flight paths that are of the same shape and length in each ion-optical cell.

* * * * *